US010854938B2

(12) United States Patent
Kim et al.

(10) Patent No.: US 10,854,938 B2
(45) Date of Patent: Dec. 1, 2020

(54) ANTENNA APPARATUS INCLUDING PHASE SHIFTER

(71) Applicant: Samsung Electronics Co., Ltd., Gyeonggi-do (KR)

(72) Inventors: Young-Jong Kim, Gyeonggi-do (KR); Dongsik Shin, Gyeonggi-do (KR); Jonghwa Kim, Seoul (KR); Hae-Gweon Park, Gyeonggi-do (KR); Byungtae Yoon, Gyeonggi-do (KR); Jong Wook Zeong, Gyeonggi-do (KR); Soon-Ho Hwang, Seoul (KR)

(73) Assignee: Samsung Electronics Co., Ltd

( * ) Notice: Subject to any disclaimer, the term of this patent is extended or adjusted under 35 U.S.C. 154(b) by 145 days.

(21) Appl. No.: 16/116,225

(22) Filed: Aug. 29, 2018

(65) Prior Publication Data

US 2019/0067770 A1 Feb. 28, 2019

(30) Foreign Application Priority Data

Aug. 29, 2017 (KR) ..... 10-2017-0109618

(51) Int. Cl.

| | |
|---|---|
| ***H01Q 21/06*** | (2006.01) |
| ***H01Q 3/36*** | (2006.01) |
| ***H01Q 21/22*** | (2006.01) |
| ***H01P 1/18*** | (2006.01) |
| ***H01Q 1/42*** | (2006.01) |
| ***H01Q 1/24*** | (2006.01) |

(Continued)

(52) U.S. Cl.

CPC ..... *H01P 1/182* (2013.01); *H01P 1/18* (2013.01); *H01P 1/184* (2013.01); *H01Q 1/246* (2013.01); *H01Q 1/42* (2013.01); *H01Q 3/32* (2013.01); *H01Q 3/36* (2013.01); *H01Q 15/14* (2013.01); *H01Q 21/06* (2013.01); *H01Q 21/065* (2013.01); *H01Q 21/22* (2013.01)

(58) Field of Classification Search

CPC . H01P 1/182; H01P 1/184; H01P 1/18; H01Q 21/06; H01Q 15/14; H01Q 3/32; H01Q 1/42; H01Q 3/36; H01Q 1/246; H01Q 21/22; H01Q 21/065

USPC ..... 343/893

See application file for complete search history.

(56) References Cited

U.S. PATENT DOCUMENTS 4,356,462 A * 10/1982 Bowman ..... H01Q 3/22 333/128

5,495,249 A * 2/1996 Chazelle ..... G08G 5/0026 342/36

(Continued)

*Primary Examiner* — Hai V Tran

(74) *Attorney, Agent, or Firm* — The Farrell Law Firm, P.C.

(57) ABSTRACT

A phase shifter is disclosed and includes a first substrate comprising a phase change line; and a second substrate comprising an input line connected to an input port, a first output line connected to a first output port, a second output line connected to a second output port, and a connection line connecting the first output line and the second output line. The first substrate is disposed to face the second substrate and to be overlaid at a predetermined distance from the second substrate. A phase of a signal passing through a first portion of the phase change line changes by a first value according to a movement of the first substrate. The signal is branched into a first signal to be transmitted to the first output port and a second signal to be transmitted to the second output port.

18 Claims, 28 Drawing Sheets

(51) Int. Cl.
*H01Q 15/14* (2006.01)
*H01Q 3/32* (2006.01)

(56) References Cited

U.S. PATENT DOCUMENTS

| | | | | |
|---|---|---|---|---|
| 7,589,603 | B2 * | 9/2009 | Tae | H01P 1/184 333/156 |
| 8,907,744 | B2 | 12/2014 | Moon et al. | |
| 2008/0297273 | A1 * | 12/2008 | Murano | H01P 1/184 333/161 |

* cited by examiner

ANTENNA APPARATUS INCLUDING PHASE SHIFTER

CROSS-REFERENCE TO RELATED APPLICATION(S)

This application is based on and claims priority under 35 U.S.C. § 119(a) to Korean Patent Application Serial No. 10-2017-0109618, which was filed on Aug. 29, 2017, in the Korean Intellectual Property Office, the entire disclosure of which is incorporated by reference herein.

BACKGROUND

1. Field

The present disclosure relates, generally, to an antenna apparatus, and more particularly, to an antenna apparatus including a phase shifter.

2. Description of the Related Art

In domestic and overseas mobile communication systems, the density of subscribers varies by region and time zone. In order to provide optimal service, network management is performed to adjust the coverage of a base station by adjusting a vertical beam angle of a base station antenna.

A mechanical beam tilt method, in a conventional wireless communication system, can be used to adjust the coverage of the base station. Conventional mechanical beam tilt methods can directly adjust the direction of an antenna radiation beam by adjusting an angle of the antenna using a mechanical beam tilt device mounted on the antenna.

An advantage of the mechanical beam tilt method is that the production cost of an antenna can be reduced. However, in order to operate the base station, it is sometimes necessary for a technician to directly go up to the antenna tower of the base station and perform a complicated process that, typically, can include of loosening multiple bolts for fixing a mechanical beam tilt component, changing the antenna angle, and then tightening the bolts again. As can be appreciated, performing such a procedure can be extremely dangerous, e.g., there is a risk of a the technician falling from the antenna tower, and the process can be quite time consuming.

SUMMARY

The disclosure has been made to address at least the disadvantages described above and to provide at least the advantages described below. Accordingly, an aspect of the disclosure provides an electric beam tilt system, which is capable of adjusting the beam tilt of a base station antenna. The electric beam system includes a phase shifter for adjusting the phase of a beam.

Accordingly, an aspect of the disclosure provides a phase shifter that is configured, when changing a phase of a signal transmitted to each output port in accordance with movement of a second substrate, to adjust not only the phase of a signal transmitted to one port included in a first substrate, but also a phase of a signal transmitted to another output port included in the first substrate using one phase change line included in the second substrate.

In accordance with an embodiment, there is provided a phase shifter. The phase shifter includes a first substrate comprising a phase change line and a second substrate comprising an input line connected to an input port, a first output line connected to a first output port, a second output line connected to a second output port, and a connection line connecting the first output line to the second output line. The first substrate faces the second substrate and overlays from the second substrate at a predetermined distance. A phase of a signal passing through a first portion of the phase change line changes by a first value according to a movement of the first substrate. The signal passing through the first portion of the phase change line is branched into a first signal and a second signal that are configured to be transmitted to the first output port and the second output port, respectively.

In accordance with an embodiment, there is provided a phase shifter. The phase shifter includes a first substrate comprising a phase change line and a second substrate comprising an input line connected to an input port, a first output line connected to a first output port, a second output line connected to a second output port, and a connection line connecting the first output line to the second output line. The first substrate faces the second substrate and overlays from the second substrate at a predetermined distance. A phase of a signal passing through a first portion of the connection line changes by a first value according to a movement of the first substrate. The signal passing through the first portion of the connection line is branched into a first signal and a second signal that are configured to be transmitted to the first output port and the second output port, respectively.

In accordance with an embodiment, there is provided an antenna apparatus. The antenna apparatus includes a housing, a first radiating element and a second radiating element disposed inside the housing, and a phase shifter disposed inside the housing and comprising a first substrate comprising a phase change line and a second substrate comprising an input line connected to an input port, a first output line connected to a first output port, a second output line connected to a second output port, and a connection line connecting the first output line and the second output line. The first substrate faces the second substrate and overlays from the second substrate at a predetermined distance. A phase of a signal passing through a first portion of the phase change line changes by a first value according to a movement of the first substrate. The signal passing through the first portion of the phase change line is branched into a first signal and a second signal that are configured to be transmitted to the first output port and the second output port, respectively.

BRIEF DESCRIPTION OF THE DRAWINGS

The above and other aspects, features and advantages of certain embodiments of the disclosure will be more apparent from the following detailed description taken in conjunction with the accompanying drawings, in which.

DETAILED DESCRIPTION

Figure 1A:
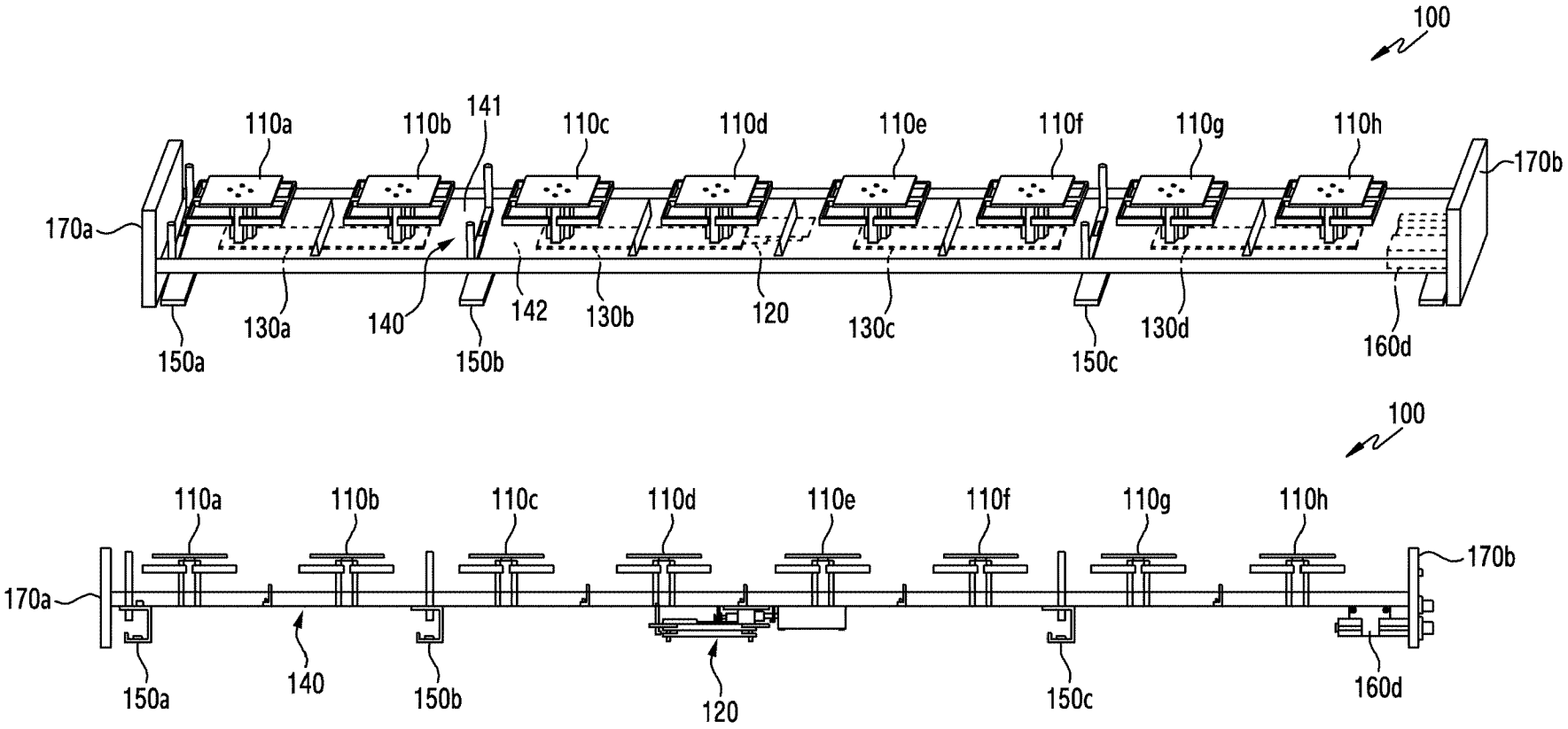
FIG. 1A is a diagram of a beam tilt antenna, according to embodiment.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may use corresponding components regardless of importance or an order and are used to distinguish a component from another without limiting the components. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

The terms used in describing the various embodiments of the disclosure are for the purpose of describing particular embodiments and are not intended to limit the disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the disclosure.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the disclosure may include at least one of an application-specific integrated circuit (ASIC) chip, a field-programmable gate array (FPGA), and a programmable-logic device for performing operations which has been known or are to be developed hereinafter.

Figure 1B:
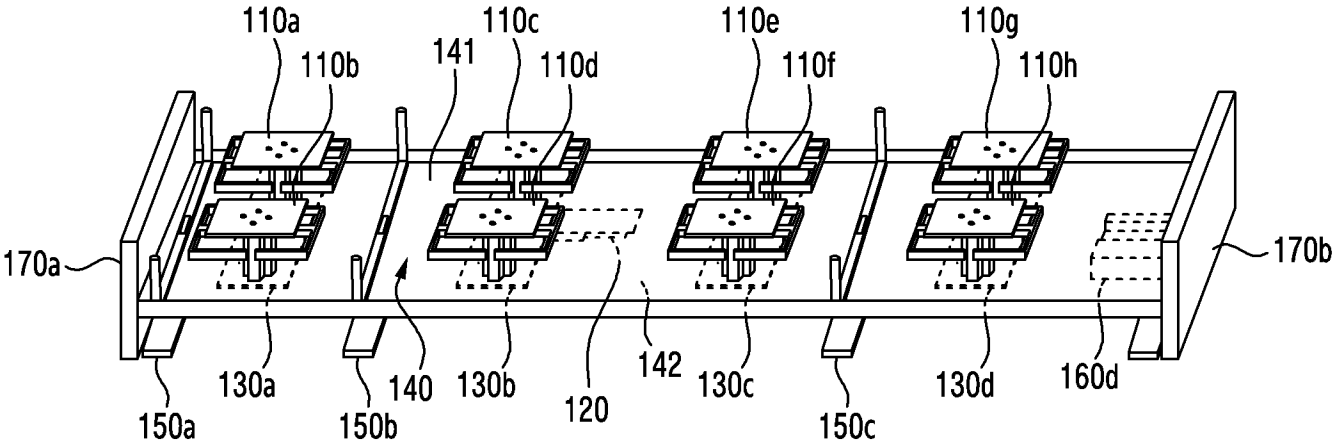
FIG. 1B is a diagram of a beam tilt antenna, according to embodiment.
Figure 1C:
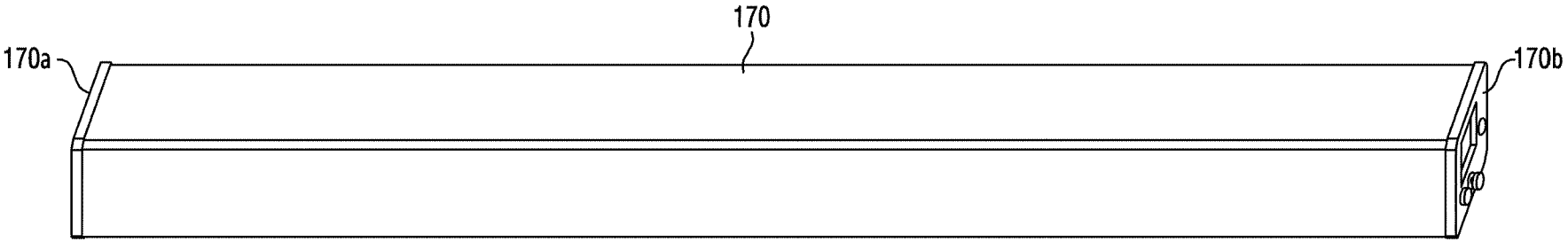
FIG. 1C is a diagram of a housing of a beam tilt antenna, according to embodiment.

FIG. 1A is a diagram of a beam tilt antenna, according to an embodiment. FIG. 1B is a diagram of a beam tilt antenna, according to an embodiment. FIG. 1C is a diagram of a housing of a beam tilt antenna, according to an embodiment.

Referring to FIGS. 1A to 1C, a beam tilt antenna 100 includes a reflector 140, which may be fixed by fixing members 150*a* to 150*c* that are spaced apart from a surface within a housing 170 by a predetermined distance. The reflector 140 is capable of enhancing the directivity and gain of signals by reflecting the signals radiated from radiating elements 110*a* to 110*h*.

The radiating elements 110*a* to 110*h* are disposed on a first surface 141 of the reflector 140. Among the radiating elements 110*a* to 110*h*, two adjacent radiating elements (e.g., the radiating element 110*a* and the radiating element 110*b*, the radiating element 110*c* and the radiating element 110*d*, the radiating element 110*e* and the radiating element 110*f*, and the radiating element 110*g* and the radiating element 110*h*) are configured as a pair, so that the two adjacent radiating elements can radiate the same signal transmitted from the same output port. The radiating elements 110*a* to 110*h* may be arranged in a 1×8 form, or as shown in FIG. 1B, the radiating elements 110*a* to 110*h* may be arranged in a 2×4 form.

On a second surface 142 of the reflector 140, a phase shifter 120, conductive members 130*a* to 130*d*, and an input/output stage 160 are disposed. The phase shifter 120 adjusts the phase of a signal input to an input port, and then transmits the adjusted signal to an output port. The conductive members 130*a* to 130*d* may deliver phase-adjusted signals output from respective output ports of phase shifter 120 to the radiating elements 110*a* to 110*h*. Thus, the radiating elements 110*a* to 110*h* radiate phase-regulated signals. The phase shifter 120 controls a radiating pattern (e.g., a direction) of the signals output from the radiating elements 110*a* to 110*h* by adjusting the phases of the input signals.

The input/output stage 160 may receive a signal generated by a processor and a radio frequency (RF) circuit of a transmission apparatus (e.g., a base station) including the antenna 100. The input/output stage 160 may deliver the input signal to the phase shifter 120.

The radiating element 110*a*, the radiating element 110*b*, the phase shifter 120, the conductive member 130, and the input/output stage 160 disposed on the first surface 141 and second surface 142 of the reflector 140 are embedded in the housing 170, a cover 170*a*, and a cover 170*b*.

Figure 2A:
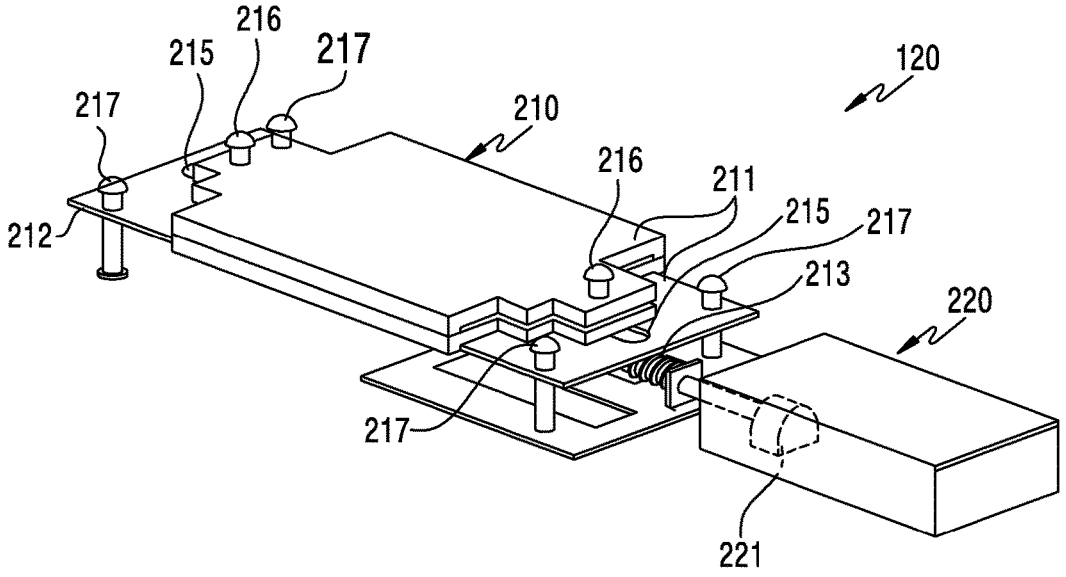
FIG. 2A is a diagram of a phase shifter, according to embodiment.
Figure 2A:
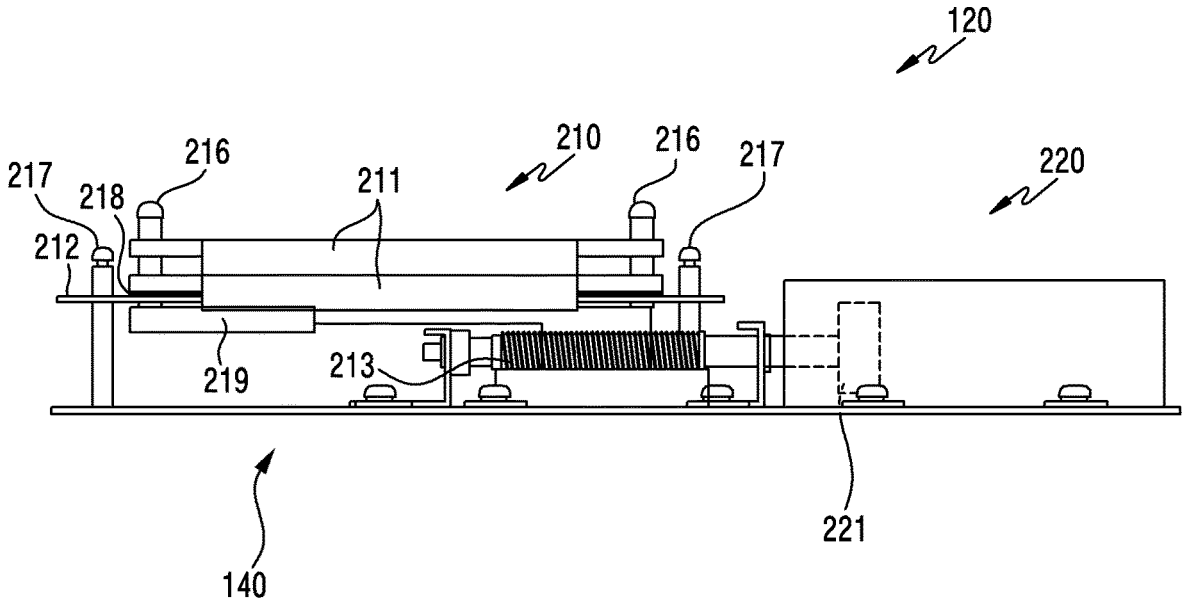
Figure 2B:
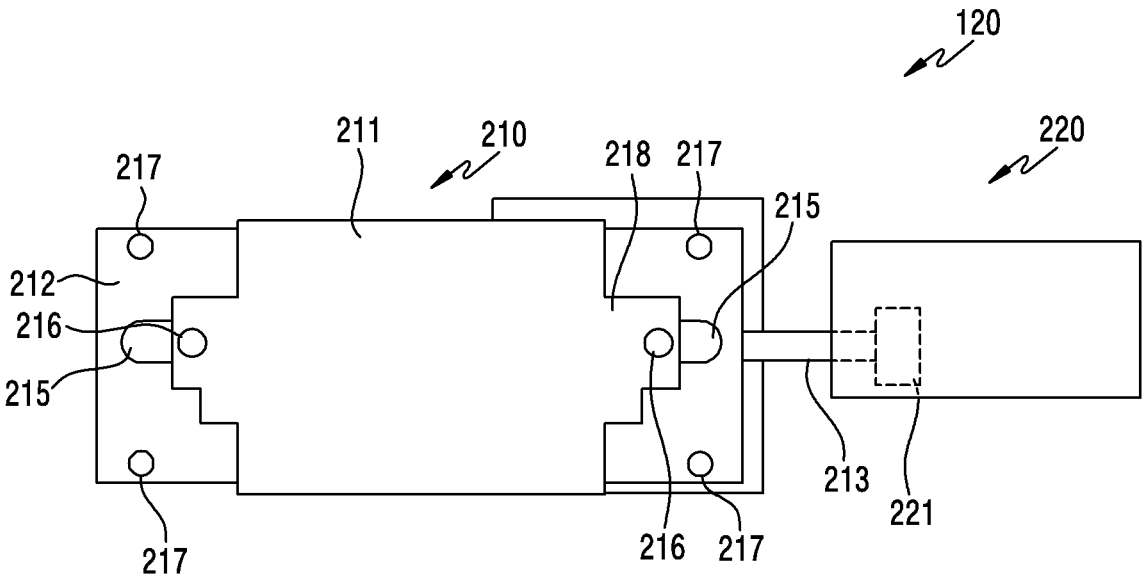
FIG. 2B is a diagram of the phase shifter, according to embodiment.
Figure 2B:
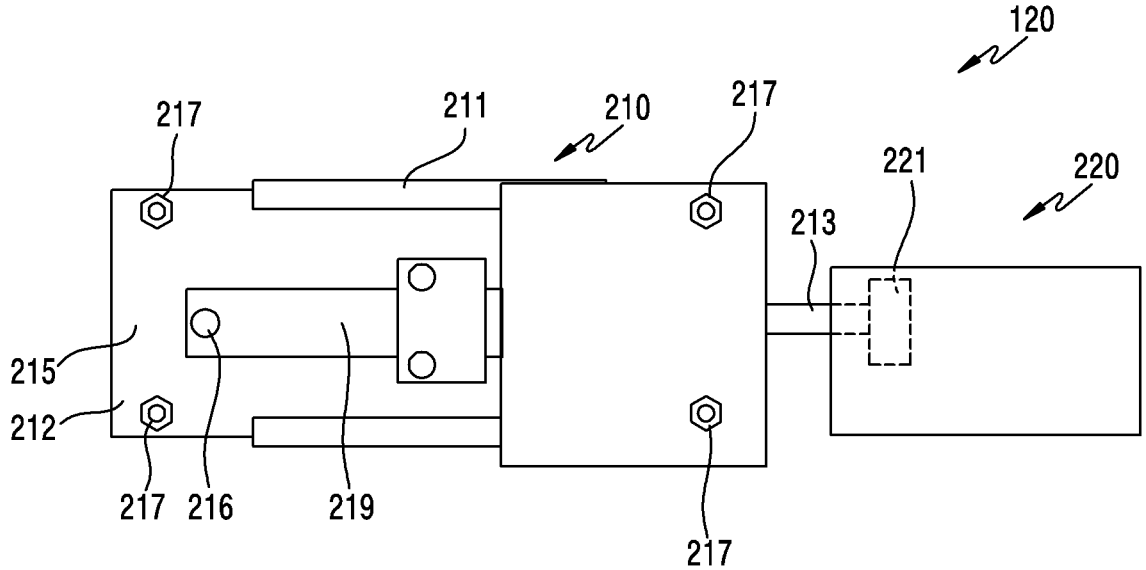
Figure 2C:
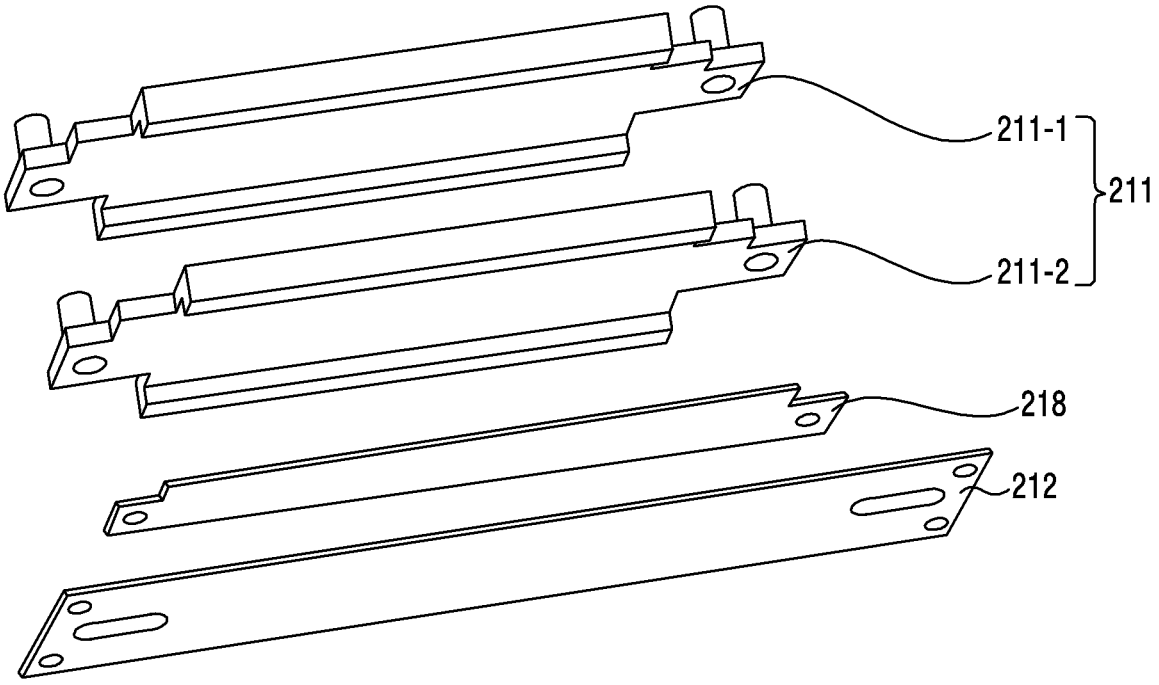
FIG. 2C is a diagram of a phase change unit, according to embodiment.

FIG. 2A is a diagram of a phase shifter, according to an embodiment. FIG. 2B is a diagram of the phase shifter, according to an embodiment. FIG. 2C is a diagram of the phase change unit, according to an embodiment.

Referring to FIGS. 2A to 2C, the phase shifter 120 includes a phase change unit 210 and a driving unit 220.

The phase change unit 210 includes a first substrate 212 and a second substrate 218 disposed to face each other. The first substrate 212 may be overlaid and positioned at a distance from the second substrate 218, facing the second substrate 218. The second substrate 218 is mounted on a movable member 211 and may be spaced apart from the first substrate 212 by a predetermined distance. An input line connected to an input port to which a signal before phase change is input may be disposed on the second substrate 218. The movable member 211 includes a movable sub-member 211-1 and a movable sub-member 211-2. The movable member 211 may include only with one movable sub-member 211-1. The first substrate 212 and the second substrate 218 may be embodied as a printed circuit board (PCB).

The first substrate 212 is fixed to the reflector 140 by substrate fixing pieces 217. The first substrate 212 may have an output line and a connection line connected to each of one or more output ports for outputting a phase-changed signal. The first substrate 212 includes a slit 215. The slit 215 allows substrate fixing pieces 216, to pass through the first substrate 212 so as to fix the movable member 211, on which the second substrate 218 is mounted, to a rack gear 219. In addition, the slit 215 may have the same shape as a movement path of the movable member 211 such that the flow member 211 including the second substrate 218 can be moved by the rack gear 219.

The rack gear 219 is engaged with a worm gear 213, and is linearly moved as the worm gear 213 is rotated by a motor 221 included in the driving unit 220. Since the rack gear 219 is fixed to the movable member 211, on which the second substrate 218 is mounted by the substrate fixing pieces 216, the second substrate 218 is also linearly moved following the linear movement of the rack gear 219.

Figure 3A:
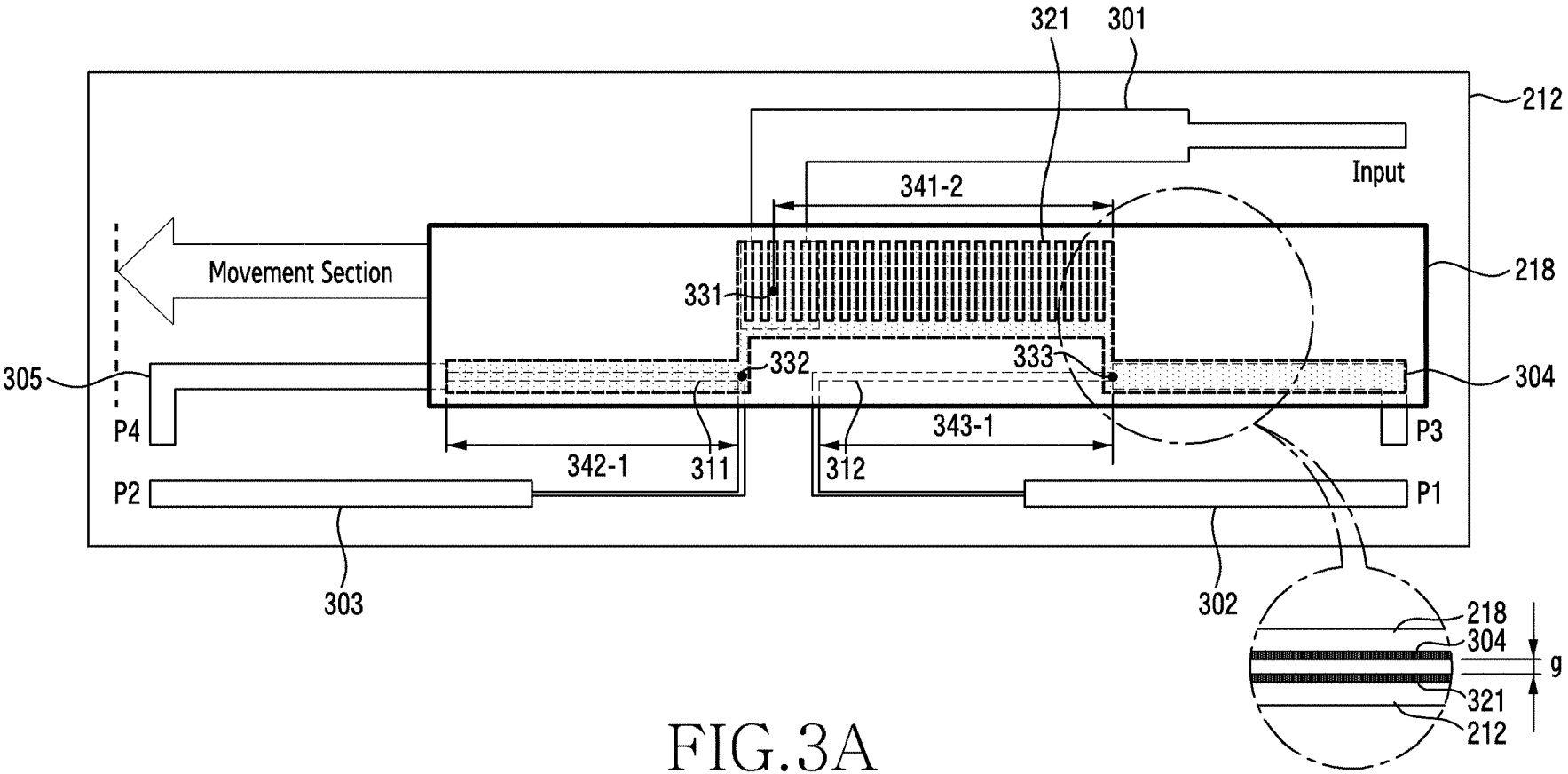
FIGS. 3A to 3C are diagrams of a phase change unit before and after movement of a second substrate, according to embodiment.
Figure 3B:
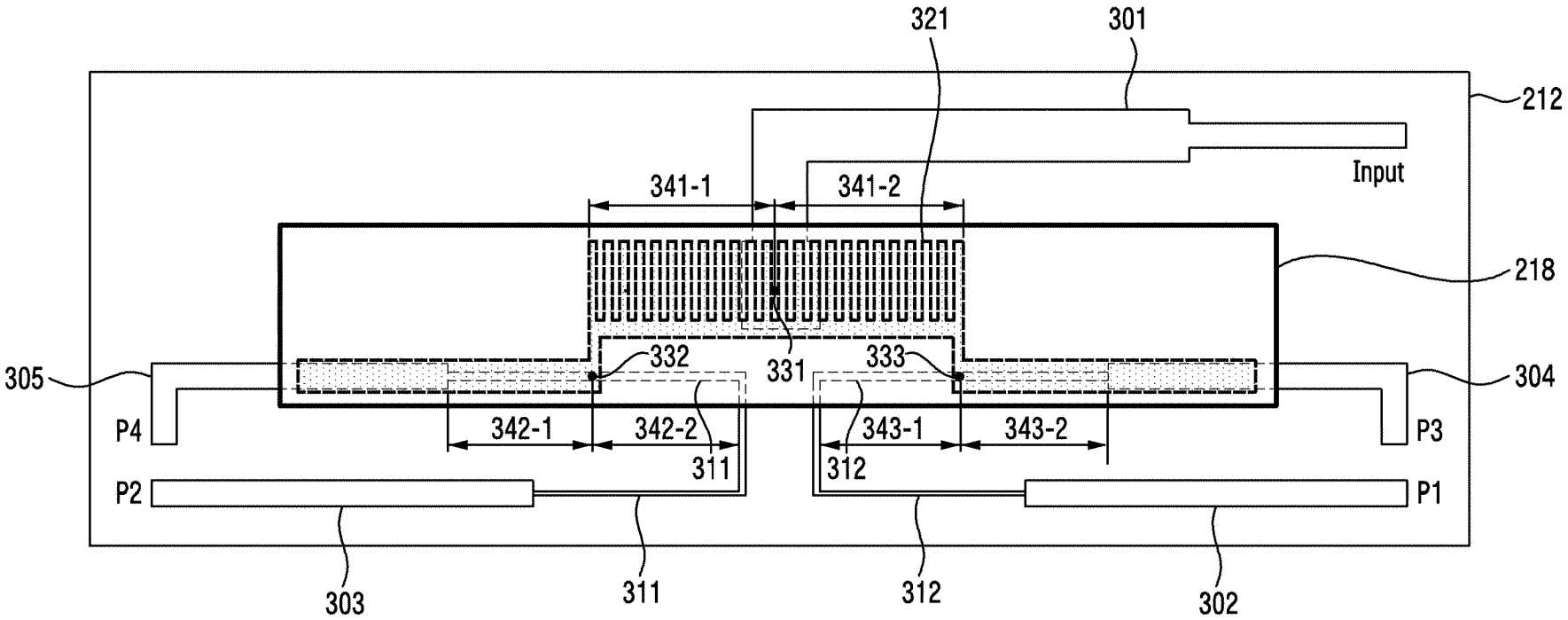
Figure 3C:
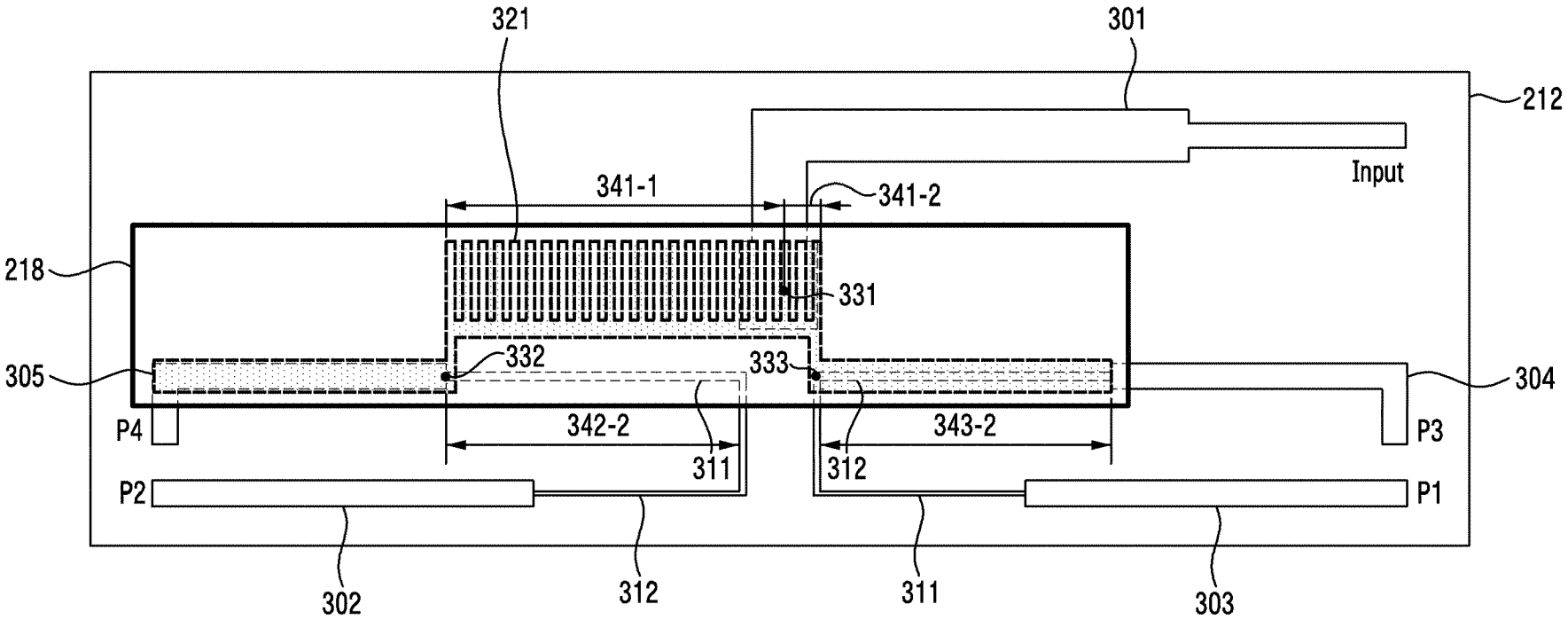

FIGS. 3A to 3C are diagrams of a phase change unit before and after movement of a second substrate, according to an embodiment.

Referring to FIGS. 3A to 3C, the first substrate 212 includes an input line 301 connected to an input port, an output line 302 connected to an output port P1, an output line 303 connected to an output port P2, an output line 304 connected to an output port P3, an output line 305 connected to an output port P4, a connection line 311, and a connection line 312. The connection line 311 may connect the output line 303 and the output line 305 to each other. In addition, the connection line 312 may connect the output line 302 and the output line 304 to each other. The second substrate 218 includes a phase change line 321. The phase change line 321 may further include a comb-shaped (or a comb-type) line, e.g., the phase change line 321 may have a comb line shape. The thicknesses of various lines included in FIGS. 3A and 3B may be designed to be different from each other so as to match impedance between neighboring lines.

Signal transmitted from the input port and passing through the input line 301 are branched, at a first branch node 331, into a signal directed toward the output ports P1 and P3 and a signal directed toward the output ports P2 and P4. The first branch node 331 may be a center of a portion where the comb-shaped line of the phase change line 321 and the input line 301 are coupled to each other.

Signals directed to the output ports P2 and P4 through a first section 341-1 of the comb-shaped line of the phase change line 321 are branched again, at a second branch node 332, into a signal transmitted to the output port P2 and a signal transmitted to the output port P4. The second branch node 332 may be a starting point at which a signal directed toward the output ports P2 and P4 through the comb-shaped line of the phase change line 321 is transmitted to the connection line 311 in a portion where the phase change line 321 and the connection line 311 are coupled to each other. The first section 341-1 may be a section from the first branch node 331 to the second branch node 332 in the comb-shaped line of the phase change line 321.

The signal transmitted to the output port P2 passes through a fourth section 342-2, and the signal transmitted to the output port P4 passes through a third section 342-1. The third section 342-1 may be a section from the second branch node 332 to the end point of the connection line 311 connected to the output line 305. The fourth section 342-2 may be a section from the second branch node 332 to the end point of the connection line 311 connected to the output line 303.

In addition, signals directed to the output ports P1 and P3 through the second section 341-2 of the comb-shaped line of the phase change line 321 are branched again, at a third branch node 333, into a signal transmitted to the output port P1 and a signal transmitted to the output port P4. The third branch node 333 may be a starting point at which a signal directed toward the output ports P1 and P3 through the comb-shaped line of the phase change line 321 is transmitted to the connection line 312 in a portion where the phase change line 321 and the connection line 312 are coupled to each other. The second section 341-2 may be a section from the first branch node 331 to the third branch node 333 in the comb-shaped line of the phase change line 321.

The signal transmitted to the output port P1 passes through a fifth section 343-1, and the signal transmitted to the output port P4 passes through a sixth section 343-2. The phase change line 321 disposed on the second substrate 218 may be spaced apart from the output line 304 disposed on the first substrate 212 by an interval g. The fifth section 343-1 may be a section from the third branch node 333 to the end point of the connection line 312 connected to the output line 302. The sixth section 343-2 may be a section from the third branch node 333 to the end point of the connection line 311 connected to the output line 304. The phase delay line 321 may include various types of lines other than a comb-shaped line in order to change the phase by a second phase (β°).

As the second substrate 218 moves, the length of the first section 341-1 increases by the length of the movement section of the second substrate 218. Therefore, the phase of the signal directed toward the output ports P2 and P4 through the first section 341-1 increases by the second phase (β°).

As the second substrate 218 moves, the length of the third section 342-1 decreases by the length of the movement section of the second substrate 218. The phase of the signal transmitted to the output port P4 through the third section 342-1 decreases by the first phase) (α°). As a result, the phase of the signal transmitted to the output port P4 after the movement of the second substrate 218 changes by −α°+β°, compared to the phase before the movement of the second substrate 218.

As the second substrate 218 moves, the length of the fourth section 342-2 increases by the length of the movement section of the second substrate 218. The phase of the signal transmitted to the output port P4 through the fourth section 342-2 increases by the first phase) (α°). As a result, the phase of the signal transmitted to the output port P2 after the movement of the second substrate 218 changes by +α°+β°, compared to the phase before the movement of the second substrate 218.

As the second substrate 218 moves, the length of the second section 341-2 decreases by the length of the movement section of the second substrate 218. The phase of the signal directed toward the output ports P1 and P3 through the second section 341-2 decreases by the second phase (β°).

As the second substrate 218 moves, the length of the fifth section 343-1 decreases by the length of the movement section of the second substrate 218. The phase of the signal transmitted to the output port P1 through the fifth section 343-1 decreases by the first phase) (α°). As a result, the phase of the signal transmitted to the output port P1 after the movement of the second substrate 218 changes by −α°−β°, compared to the phase before the movement of the second substrate 218.

As the second substrate 218 moves, the length of the sixth section 343-2 increases by the length of the movement section of the second substrate 218. The phase of the signal transmitted to the output port P3 through the sixth section 343-2 increases by the first phase) (α°). As a result, the phase of the signal transmitted to the output port P3 after the movement of the second substrate 218 changes by +α°−β°, compared to the phase before the movement of the second substrate 218.

The phase change amount (−α°−β°) of the signal transmitted to the output port P1 due to the movement of the second substrate 218 and the phase change amount (+α°+β°) of the signal transmitted to the output port P2 are in a symmetrical relationship. Additionally, the phase change amount (+α°−β°) of the signal transmitted to the output port P3 due to the movement of the second substrate 218 and the phase change amount (−α°+β°) of the signal transmitted to the output port P4 are in a symmetrical relationship.

In changing the phases of the signals transmitted to the respective output ports according to the movement of the second substrate 218, the first section 341-1 may be used for adjusting not only the phase of the signal transmitted to the output port P2, but also the phase of the signal transmitted to the output port P4 equally by the second phase (β°). That is, since a phase change line for adjusting the phase of the signal transmitted to the output port P2 by the second phase (β°) and a phase change line for adjusting the phase of the signal transmitted to the output port P4 by the second phase (β°) are not separately required, the size of the phase shifter 120 can be reduced.

In changing the phases of the signals transmitted to the respective output ports according to the movement of the second substrate 218, the second section 341-2 may be used for adjusting not only the phase of the signal transmitted to the output port P1, but also the phase of the signal transmitted to the output port P3 equally by the second phase (β°). That is, since a phase change line for adjusting the phase of the signal transmitted to the output port P1 by the second phase (β°) and a phase change line for adjusting the phase of the signal transmitted to the output port P3 by the second phase (β°) are not separately required, the size of the phase shifter 120 can be reduced.

Figure 4A:
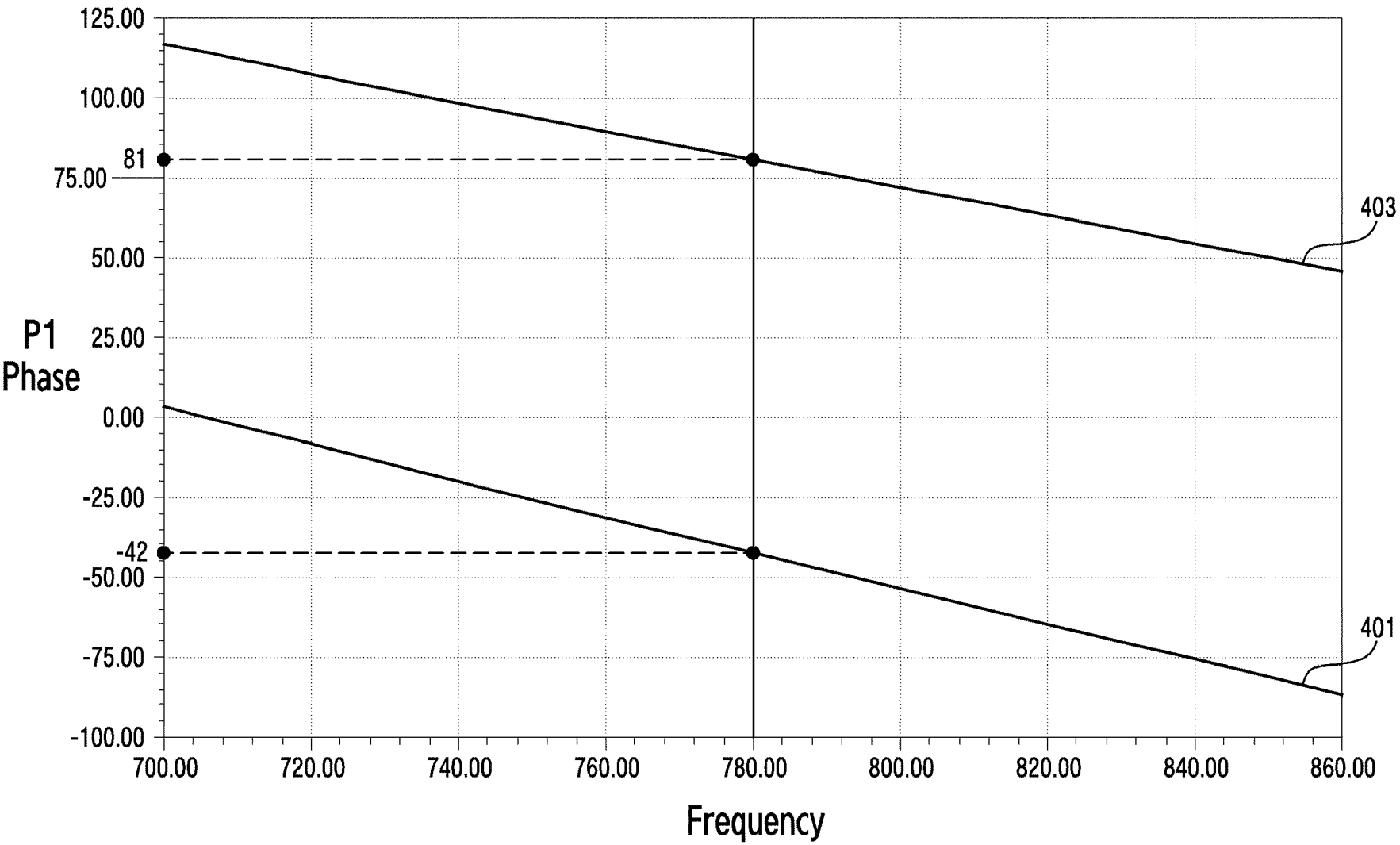
FIGS. 4A to 4D are graphs of output ports, according to embodiment.
Figure 4B:
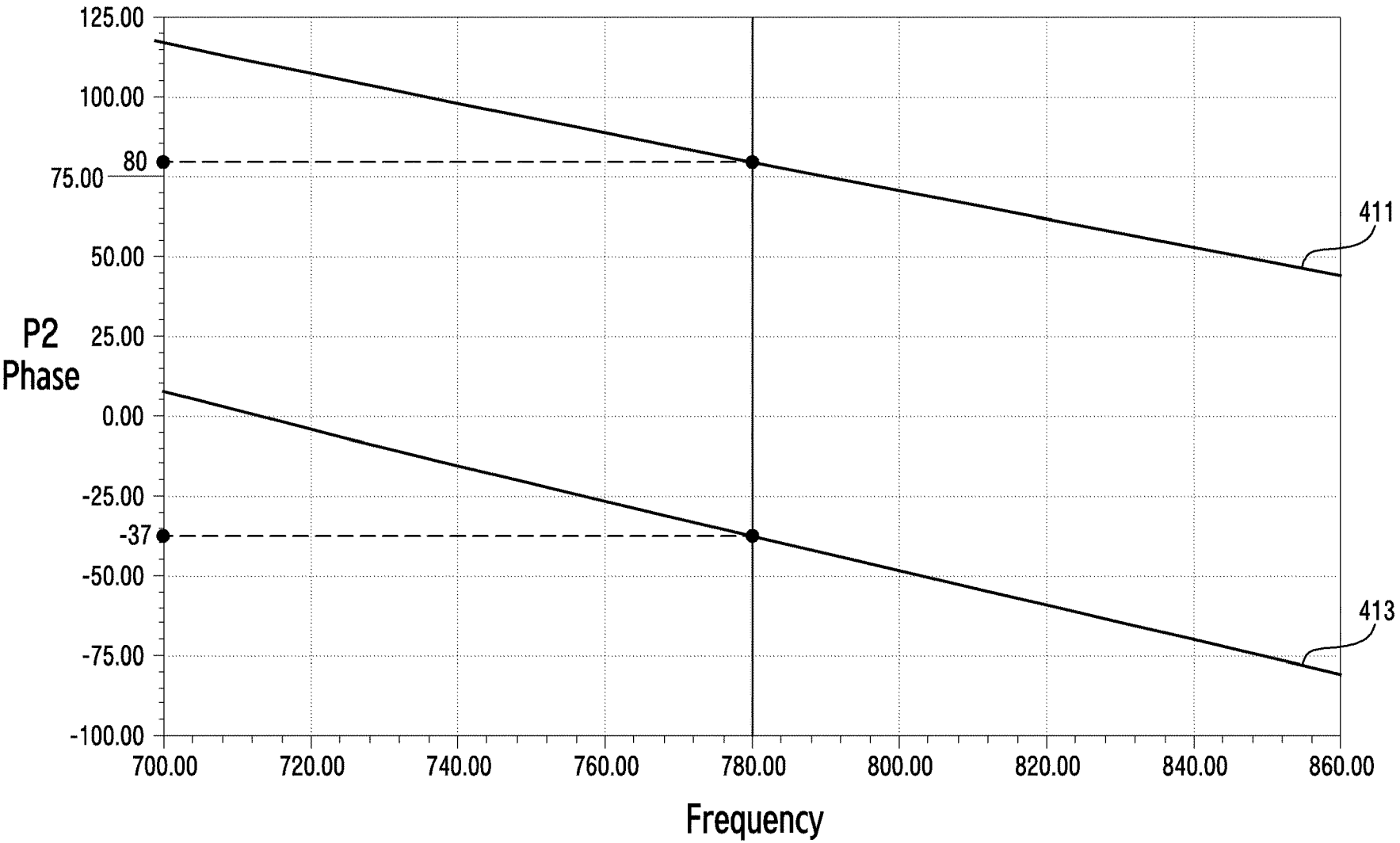

FIGS. 4A to 4D are graphs for respective output ports, according to an embodiment. FIGS. 4A and 4B are phase graphs for respective output ports when the first substrate 212 and the second substrate 218 have line structures as shown in FIGS. 3A and 3B, respectively. The x-axis of the phase graphs indicates a frequency of a signal transmitted to each output port, and the y-axis indicates a phase of a signal transmitted to each output port.

Referring to FIG. 4A, line 403 represents the phase of a signal transmitted to the output port P1 corresponding to the frequency of a signal transmitted to the output port P1 before the second substrate 218 moves, that is, a default phase. Line 401 represents a phase of a signal transmitted to the output port P1 according to the frequency of a signal transmitted to the output port P1 after the second substrate 218 moves. For example, when the frequency of a signal transmitted to the output port P1 is 780 Hz, and when the default phase of a signal transmitted to the output port P1 is 81° before the second substrate 218 moves, the phase of a signal transmitted to the output port P1 after the second substrate 218 moves may be −42°. The phase change amount of the signal transmitted to the output port P1, which is generated according to the movement of the second substrate 218, may be −123°. When the first substrate 212 and the second substrate 218 have the line structures as in FIGS. 3A and 3B, the phase change amount (α°−β°) of the signal transmitted to the output port P1 may be −123°.

Referring to FIG. 4B, line 413 represents the phase of a signal transmitted to the output port P2 corresponding to the frequency of a signal transmitted to the output port P2 before the second substrate 218 moves, that is, a default phase. Line 411 represents the phase of a signal transmitted to the output port P2 according to the frequency of a signal transmitted to the output port P2 after the second substrate 218 moves. For example, when the frequency of a signal transmitted to the output port P2 is 780 Hz, and when the default phase of a signal transmitted to the output port P2 is −37° before the second substrate 218 moves, the phase of a signal transmitted to the output port P2 after the second substrate 218 moves may be 80°. The phase change amount of the signals transmitted to the output port P2 before and after the second substrate 218 moves, may be +117°. When the first substrate 212 and the second substrate 218 have the line structures as in FIGS. 3A and 3B, the phase change amount (+α°+β°) of the signals transmitted to the output port P2 may be +117°.

Figure 4C:
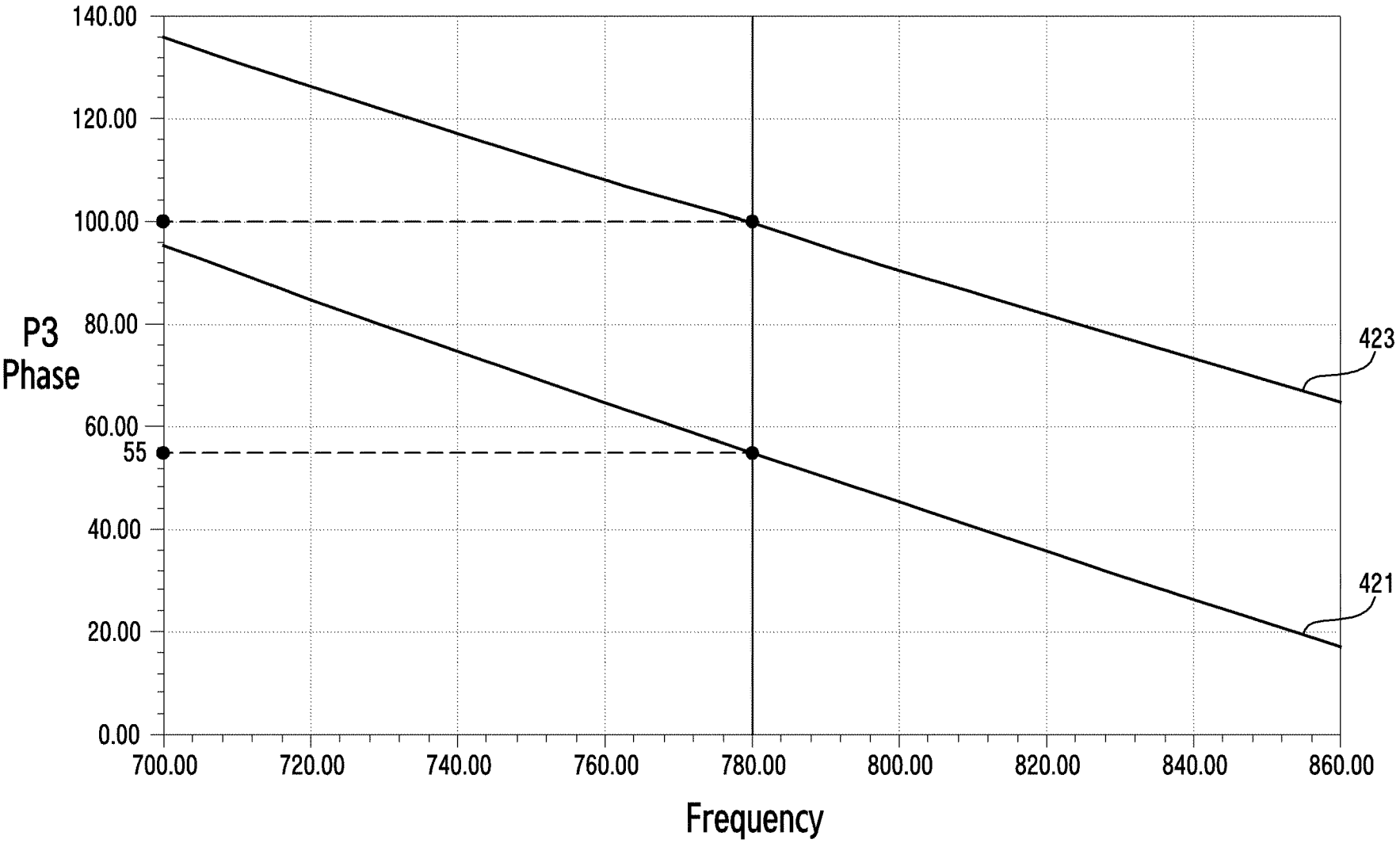

Referring to FIG. 4C, line 423 represents the phase of a signal transmitted to the output port P3 corresponding to the frequency of a signal transmitted to the output port P3 before the second substrate 218 moves, that is, a default phase. Line 421 represents the phase of a signal transmitted to the output port P3 according to the frequency of a signal transmitted to the output port P3 after the second substrate 218 moves. For example, when the frequency of a signal transmitted to the output port P3 is 780 Hz, and when the default phase of a signal transmitted to the output port P3 is 100° before the second substrate 218 moves, the phase of a signal transmitted to the output port P3 after the second substrate 218 moves may be 55°. The phase change amount of the signals transmitted to the output port P3 before and after the second substrate 218 moves, may be −45°. When the first substrate 212 and the second substrate 218 have the line structures as in FIGS. 3A and 3B, the phase change amount (+α°−β°) of the signal transmitted to the output port P3 may be −45°.

Figure 4D:
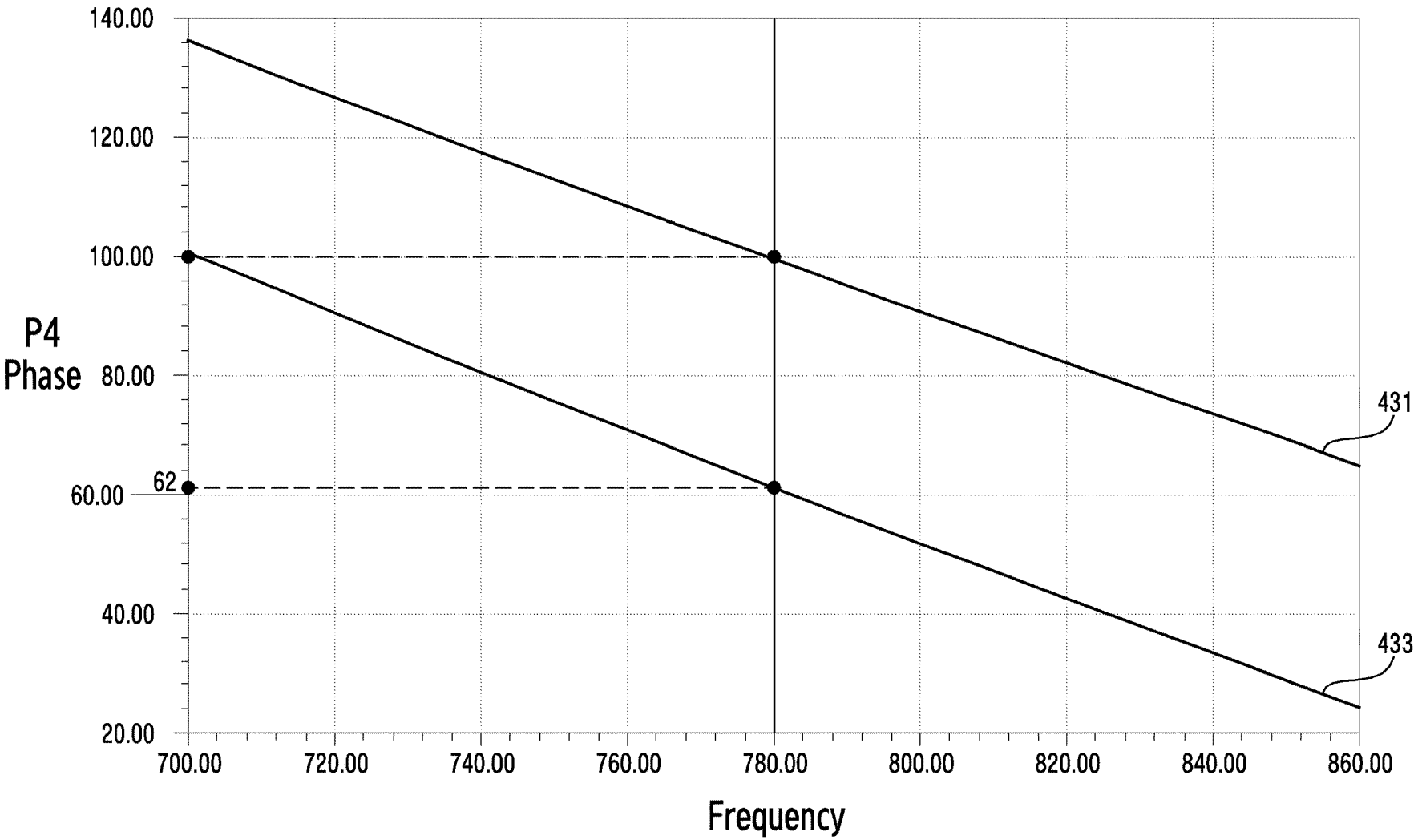

Referring to FIG. 4D, line 433 represents the phase of a signal transmitted to the output port P4 corresponding to the frequency of a signal transmitted to the output port P4 before the second substrate 218 moves, that is, a default phase. Line 431 represents the phase of a signal transmitted to the output port P4 according to the frequency of a signal transmitted to the output port P4 after the second substrate 218 moves. For example, when the frequency of a signal transmitted to the output port P4 is 780 Hz, and when the default phase of a signal transmitted to the output port P4 is 62° before the second substrate 218 moves, the phase of a signal transmitted to the output port P4 after the second substrate 218 moves may be 100°. The phase change amount of the signals transmitted to the output port P3 before and after the second substrate 218 moves, may be +38°. When the first substrate 212 and the second substrate 218 have the line structures as in FIGS. 3A and 3B, the phase change amount (−α°+β°) of the signals transmitted to the output port P4 may be +38°.

Through FIGS. 4A and 4B, although there is a slight experimental error (6°), it can be seen that the phase change amount of a signal transmitted to the output port P1 and the phase change amount of a signal transmitted to the output port P2 are in a symmetrical relationship. In addition, through FIGS. 4C and 4D, although there is a slight experimental error (7°), it can be seen that the phase change amount of a signal transmitted to the output port P3 and the phase change amount of a signal transmitted to the output port P4 are in a symmetrical relationship.

Figure 5A:
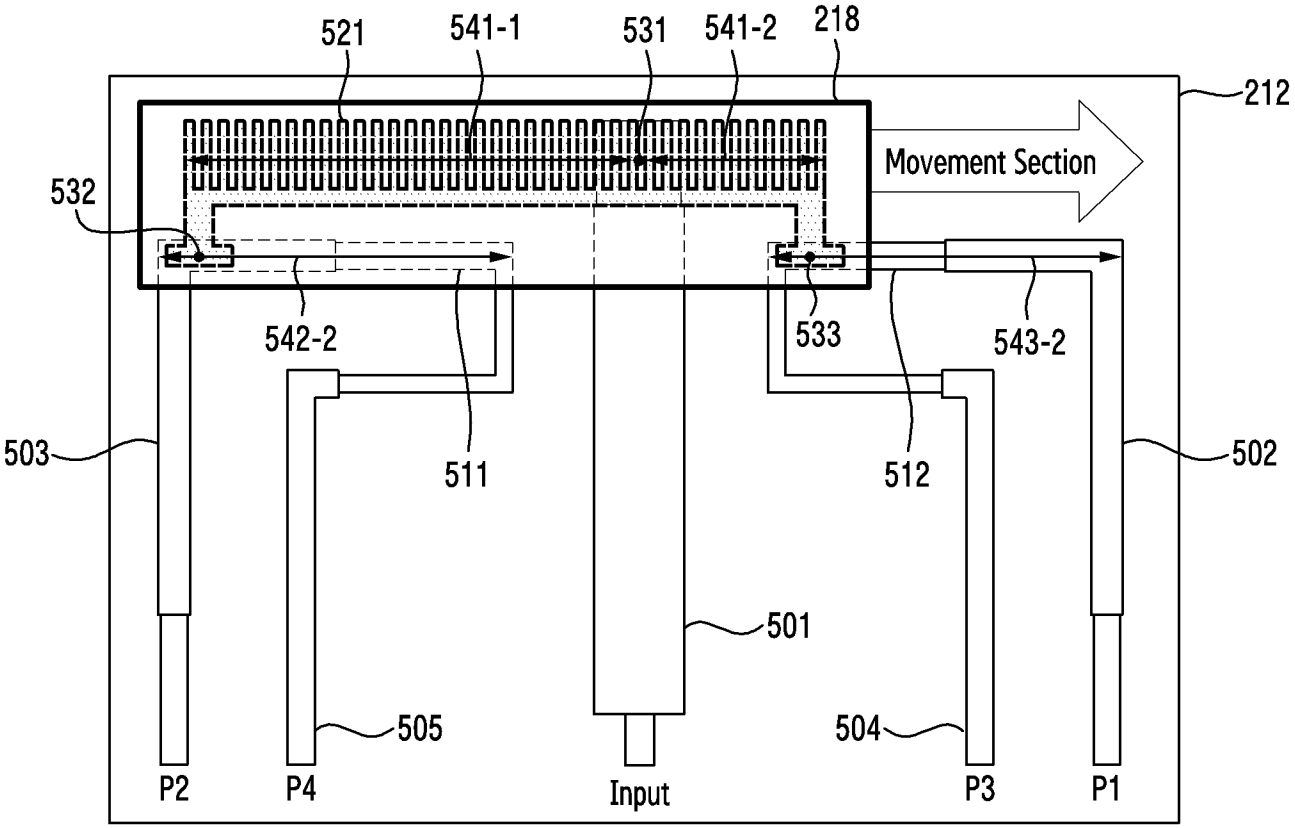
FIGS. 5A to 5C are diagrams of a first substrate configured to change the phase of an output signal before and after movement of a second substrate, according to embodiment.
Figure 5B:
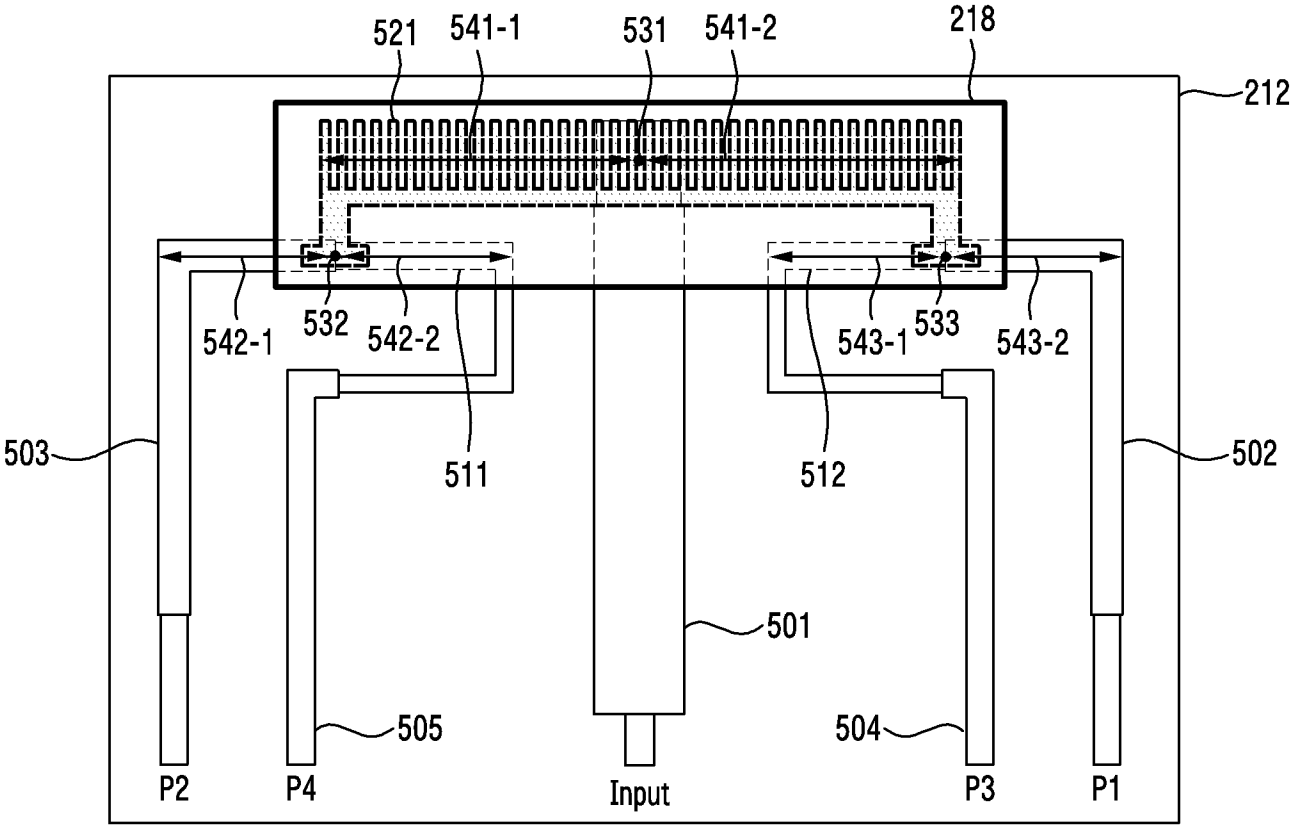
Figure 5C:
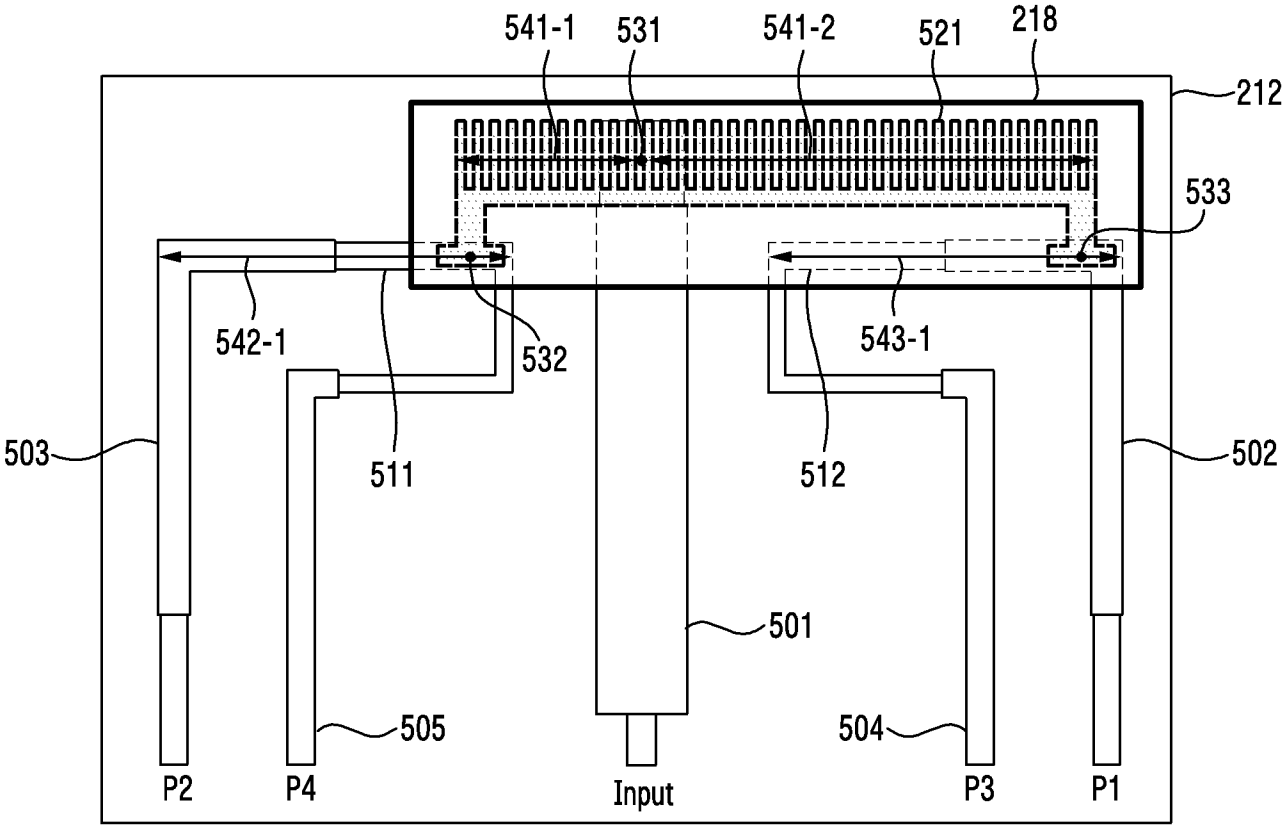

FIGS. 5A to 5C are diagrams of a first substrate configured to change the phase of an output signal before and after movement of a second substrate, according to an embodiment.

Referring to FIGS. 5A to 5C, the first substrate 212 includes an input line 501 connected to an input port, an output line 502 connected to an output port P1, an output line 503 connected to an output port P2, an output line 504 connected to an output port P3, an output line 505 connected to an output port P4, a connection line 511, and a connection line 512. The connection line 511 may connect the output line 503 and the output line 505 to each other. In addition, the connection line 512 may connect the output line 502 and the output line 504 to each other. The second substrate 218 includes a phase change line 521.

Signals transmitted from the input port and passing through the input line 501 are branched, at a first branch node 531, into a signal directed toward the output ports P1 and P3 and a signal directed toward the output ports P2 and P4. The first branch node 531 may be a center of a portion where the comb-shaped line of the phase change line 321 and the input line 501 are coupled to each other.

Signals directed toward the output ports P2 and P4 through a first section 541-1 of the comb-shaped line of the phase change line 321 are branched again, at a second branch node 532, into a signal transmitted to the output port P2 and a signal transmitted to the output port P4. The second branch node 532 may be a starting point at which a signal directed toward the output ports P2 and P4 through the comb-shaped line of the phase change line 521 is transmitted to the connection line 511 in a portion where the phase change line 521 and the connection line 511 are coupled to each other. The first section 541-1 may be a section from the first branch node 531 to the second branch node 532 in the comb-shaped line of the phase change line 521.

The signal transmitted to the output port P2 passes through a third section 542-1, and the signal transmitted to the output port P4 passes through a fourth section 542-2. The third section 542-1 may be a section from the second branch node 532 to the end point of the connection line 511 connected to the output line 503. The fourth section 542-2 may be a section from the second branch node 532 to the end point of the connection line 511 connected to the output line 505.

Signals directed toward the output ports P1 and P3 through the second section 541-2 of the comb-shaped line of the phase change line 521 are branched again, at a third branch node 533, into a signal transmitted to the output port P1 and a signal transmitted to the output port P4. The third branch node 533 may mean a starting point at which a signal directed toward the output ports P1 and P3 through the comb-shaped line of the phase change line 521 is transmitted to the connection line 512 in a portion where the phase change line 521 and the connection line 512 are coupled to each other. The second section 541-2 may be a section from the first branch node 531 to the third branch node 533 in the comb-shaped line of the phase change line 521.

The signal transmitted to the output port P1 passes through a sixth section 543-2, and the signal transmitted to the output port P3 passes through a fifth section 543-1. The fifth section 543-1 may be a section from the third branch node 533 to the end point of the connection line 512 connected to the output line 504. The sixth section 543-2 may be a section from the third branch node 533 to the end point of the connection line 512 connected to the output line 502.

As the second substrate 218 moves, the length of the first section 541-1 decreases by the length of the movement section of the second substrate 218. The phase of the signal directed toward the output ports P2 and P4 through the first section 541-1 decreases by the first phase (α°).

As the second substrate 218 moves, the length of the third section 542-1 increases by the length of the movement section of the second substrate 218. Therefore, the phase of the signal transmitted to the output port P4 through the third section 542-1 increases by the second phase (β°). As a result, the phase of the signal transmitted to the output port P2 after the movement of the second substrate 218 changes by −(α°−β°), compared to the phase before the movement of the second substrate 218.

As the second substrate 218 moves, the length of the fourth section 542-2 decreases by the length of the movement section of the second substrate 218. Therefore, the phase of the signal transmitted to the output port P4 through the fourth section 542-2 decreases by the second phase (β°). As a result, the phase of the signal transmitted to the output port P4 after the movement of the second substrate 218 changes by $-(\alpha°+\beta°)$, compared to the phase before the movement of the second substrate 218.

As the second substrate 218 moves, the length of the second section 541-2 increases by the length of the movement section of the second substrate 218. Therefore, the phase of the signal directed toward the output ports P1 and P3 through the second section 541-2 increases by the first phase ($\alpha°$).

As the second substrate 218 moves, the length of the fifth section 543-1 increases by the length of the movement section of the second substrate 218. Therefore, the phase of the signal transmitted to the output port P3 through the fifth section 543-1 increases by the second phase ($\beta°$). As a result, the phase of the signal transmitted to the output port P3 after the movement of the second substrate 218 changes by $(\alpha°+\beta°)$, compared to the phase before the movement of the second substrate 218.

As the second substrate 218 moves, the length of the sixth section 543-2 decreases by the length of the movement section of the second substrate 218. Therefore, the phase of the signal transmitted to the output port P1 through the sixth section 543-2 decreases by the second phase ($\beta°$). As a result, the phase of the signal transmitted to the output port P1 after the movement of the second substrate 218 changes by $\alpha°-\beta°$, compared to the phase before the movement of the second substrate 218.

The phase change amount $(\alpha°-\beta°)$ of the signal transmitted to the output port P1 due to the movement of the second substrate 218 and the phase change amount $(-(\alpha°-\beta°)$ of the signal transmitted to the output port P2 are in a symmetrical relationship. The phase change amount $((\alpha°+\beta°))$ of the signal transmitted to the output port P3 due to the movement of the second substrate 218 and the phase change amount $(-(\alpha°+\beta°)$ of the signal transmitted to the output port P4 are in a symmetrical relationship.

When the first substrate 212 and the second substrate 218 have line structures as shown in FIGS. 5A and 5B as described above, the phase change amount of a signal transmitted to each output port due to the movement of the second substrate 218 may be determined as illustrated in Table 1.

TABLE 1

| | Phase | |
|---|---|---|
| Output Port | Default | Change Amount |
| P1 | 0° | $(\alpha° - \beta°)$ |
| P2 | 0° | $-(\alpha° - \beta°)$ |
| P3 | 0° | $(\alpha° + \beta°)$ |
| P4 | 0° | $-(\alpha° + \beta°)$ |

When a requirement for a sidelobe of the beam-tilt antenna 100 is low, and thus no amplitude division between signals to be transmitted to respective output ports is needed, the first substrate 212 and the second substrate 218 having a line structure as shown in FIGS. 5A to 5C may be used. When power distribution between signals transmitted to the respective output ports is not required, the first substrate 212 and the second substrate 218 having a line structure as shown in FIGS. 5A to 5C may be used.

Figure 6A:
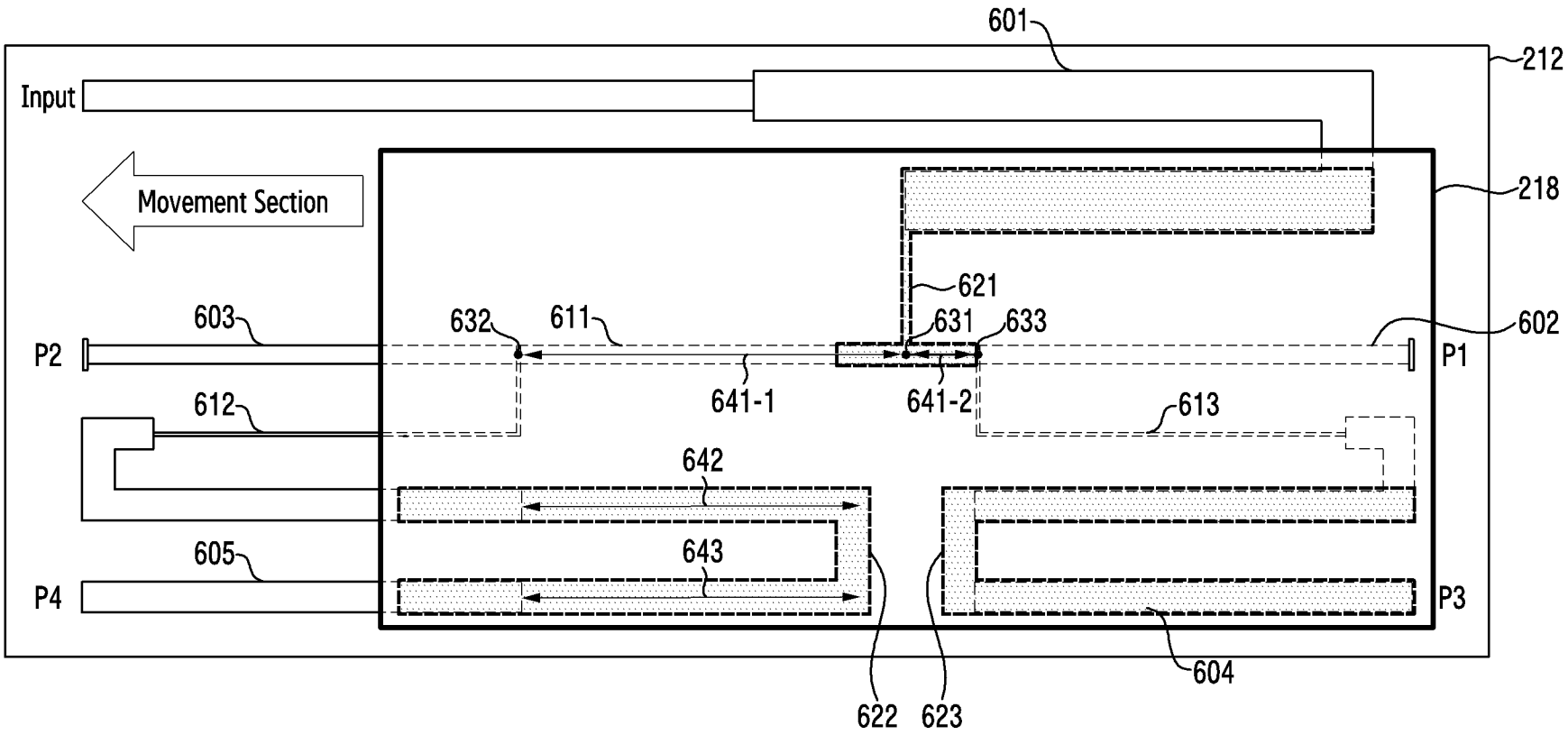
FIGS. 6A to 6C are diagrams of a first substrate configured to change the phase of an output signal before and after movement of a second substrate, according to embodiment.
Figure 6B:
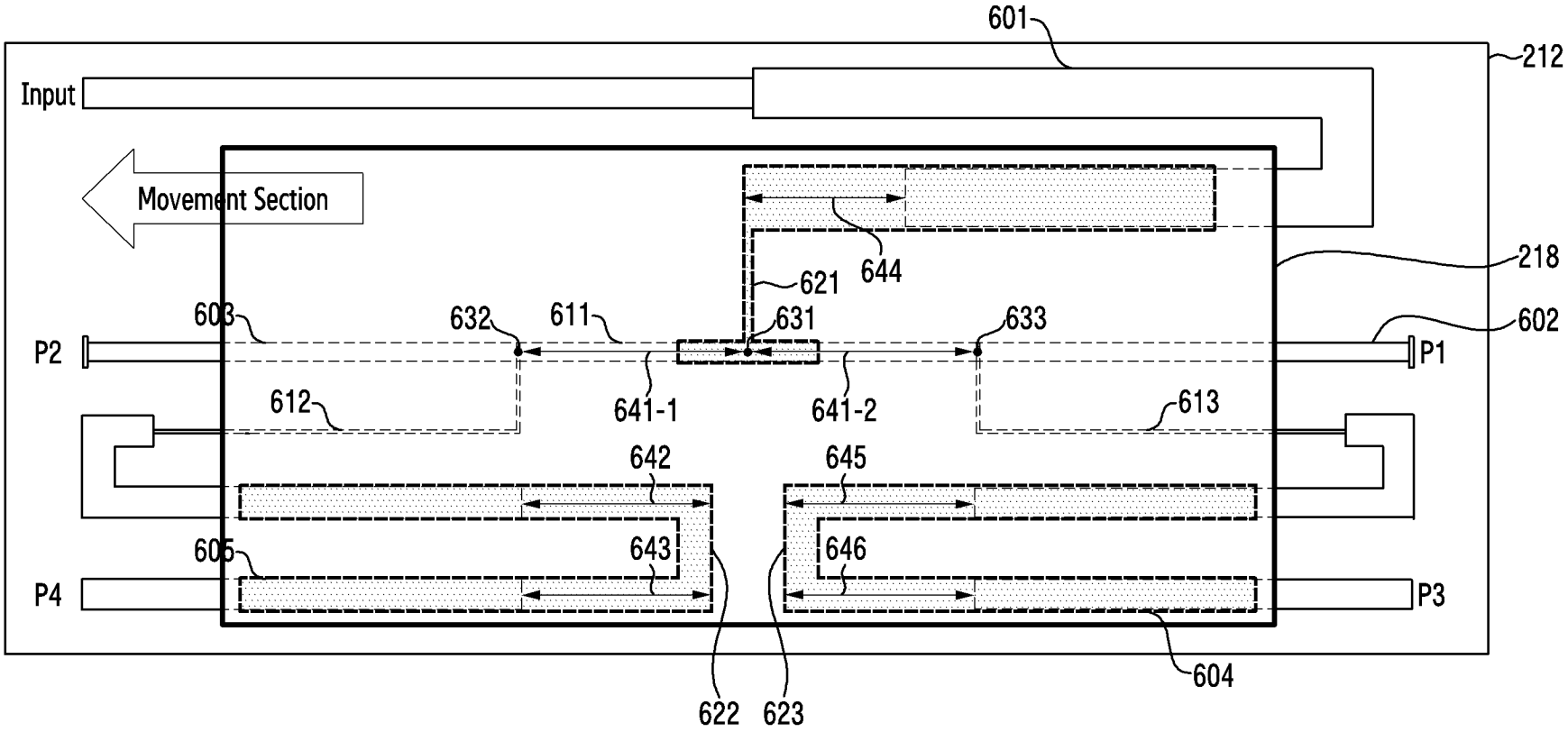
Figure 6C:
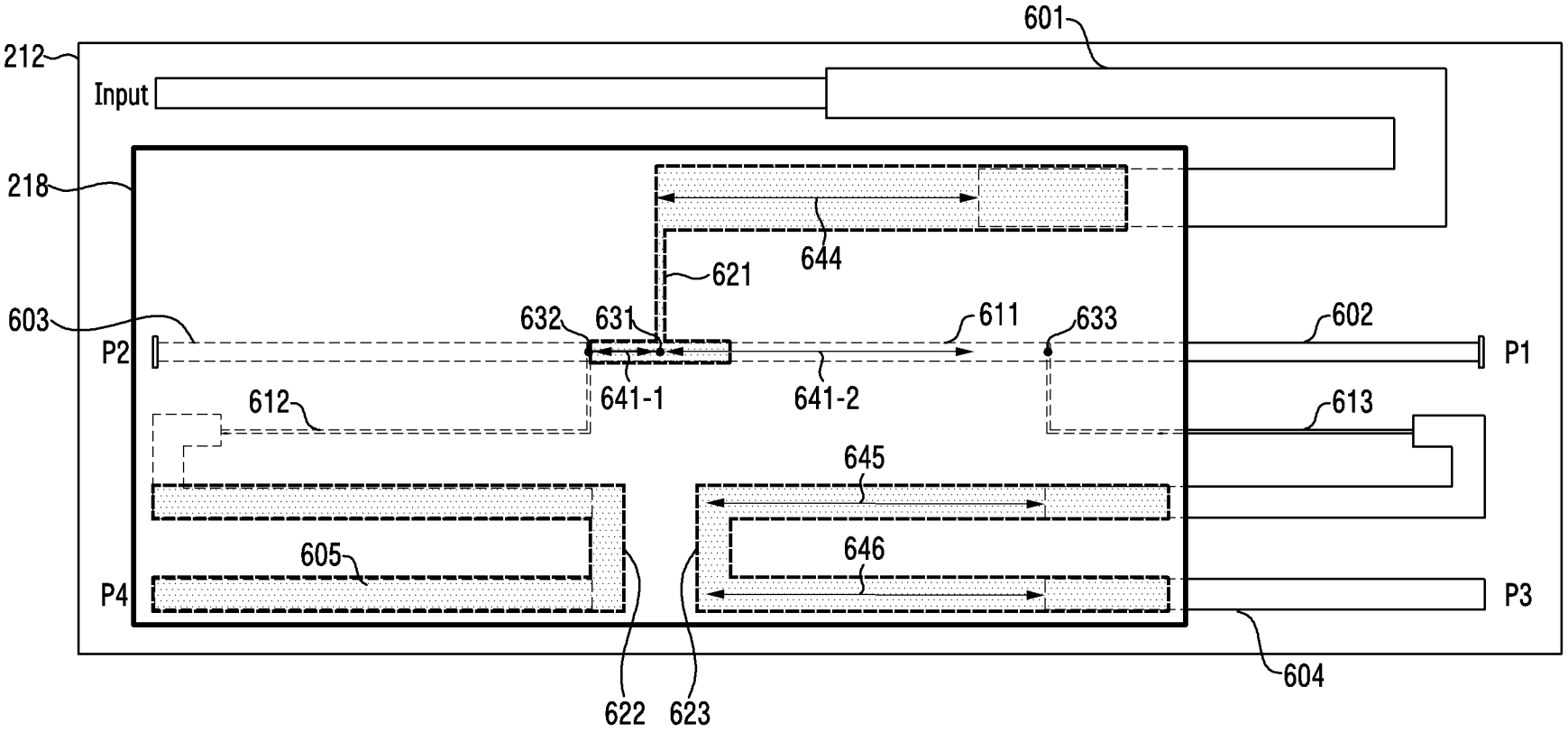

FIGS. 6A to 6C are diagrams of a first substrate configured to change the phase of an output signal before and after movement of a second substrate, according to an embodiment.

Referring to FIGS. 6A to 6C, the first substrate 212 includes an input line 601 connected to an input port, an output line 602 connected to an output port P1, an output line 603 connected to an output port P2, an output line 604 connected to an output port P3, an output line 605 connected to an output port P4, and connection lines 611 to 613. The connection line 611 may connect the output line 602 and the output line 603 to each other. The connection line 612 may be connected together at a point where the connection line 611 and the output line 603 are connected to each other. The connection line 613 may be connected together at a point where the connection line 611 and the output line 602 are connected to each other. The second substrate 218 includes a phase change line 621, a phase change line 622, and a phase change line 623. Since the phase change line 621 does not include a comb-shaped line, the size of the phase shifter 120 can be reduced. Since the phase change line 621 does not include a comb-shaped line, the phase shifter 120 is capable of adjusting more precisely the phase change amount of a signal transmitted to each output port.

A signal transmitted from an input port and passing through the input line 601 passes through a fifth section 644. The fifth section 644 may be a portion where coupling between the phase change line 621 and the input line 601 is released as the second substrate 218 moves. The signals passing through the fifth section 644 are branched, at a first branch node 631, into a signal directed toward the output ports P1 and P3 and a signal directed toward the output ports P2 and P4. The first branch node 631 may be the center of a portion where the phase change line 621 and the connection line 611 are coupled to each other.

Signals directed toward the output ports P2 and P4 through the phase change line 621 pass through a first section 641-1 and are branched again into a signal transmitted from a second branch node 632 toward the output port P2 and a signal transmitted from the second branch node 632 toward the output port P4. The second branch node 632 may be a point where the connection line 611, the connection line 612, and the output line 603 are connected together. Signals directed toward the output ports P1 and P3 through the phase change line 621 pass through a second section 641-2 and are branched again into a signal transmitted from the third branch node 633 toward the output port P1 and a signal transmitted from the third branch node 633 toward the output port P4. The third branch node 633 may be a point where the connection line 611, the connection line 613, and the output line 602 are connected together. The first section 641-1 may be a section from the first branch node 631 to the second branch node 632. The second section 641-2 may be a section from the first branch node 631 to the third branch node 633.

The signal transmitted to the output port P2 passes through the output line 603, and the signal transmitted to the output port P4 passes through a third section 642 and the fourth section 643. The third section 642 may be a candidate portion which may be additionally coupled to the connection line 612 in the phase change line 622 as the second substrate 218 moves. The fourth section 643 may be a candidate portion which may be additionally coupled to the output line 605 in the phase change line 622 as the second substrate 218 moves.

The signal transmitted to the output port P1 passes through the output line 602, and the signal transmitted to the output port P3 passes through a sixth section 645 and a seventh section 646. The sixth section 645 may be a portion where coupling with the connection line 613 is released from the phase change line 623 as the second substrate 218 moves. The seventh section 646 may be a portion where coupling with the output line 604 is released from the phase change line 623 as the second substrate 218 moves.

As the second substrate 218 moves, the length of the fifth section 644 increases by the length of the movement section of the second substrate 218. Therefore, the phase of the signal transmitted to the input port through the fifth section 644 increases by the first phase) (α°).

As the second substrate 218 moves, the length of the first section 641-1 increases by the length of the movement section of the second substrate 218. Therefore, the phase of the signal directed toward the output ports P2 and P4 through the first section 641-1 decreases by the first phase (α°).

As the second substrate 218 moves, the length of the output line 603 does not change, and the phase of the signal transmitted to the output port P2 after the movement of the second substrate 218 does not change, compared to the phase before the movement of the second substrate 218.

As the second substrate 218 moves, the length of the third section 642 and the length of the fourth section 643 decreases by the length of the movement section of the second substrate 218. Therefore, the phase of the signal transmitted to the output port P4 through the third section 642 decreases by twice the first phase (2α°). As a result, the phase of the signal transmitted to the output port P4 after the movement of the second substrate 218 changes by −2α°, compared to the phase before the movement of the second substrate 218.

As the second substrate 218 moves, the length of the second section 641-2 increases by the length of the movement section of the second substrate 218. Therefore, the phase of the signal directed toward the output ports P1 and P3 through the second section 641-2 increases by the first phase (α°).

As the second substrate 218 moves, the length of the output line 602 does not change. As a result, the phase of the signal transmitted to the output port P1 after the movement of the second substrate 218 changes by +2α°, compared to the phase before the movement of the second substrate 218.

As the second substrate 218 moves, the length of the sixth section 645 and the length of the seventh section 646 increases by the length of the movement section of the second substrate 218. Therefore, the phase of the signal transmitted to the output port P3 through the sixth section 645 and the seventh section 646 increases by twice the first phase (2α°). As a result, the phase of the signal transmitted to the output port P3 after the movement of the second substrate 218 changes by +4α°, compared to the phase before the movement of the second substrate 218.

When the first substrate 212 and the second substrate 218 have line structures as shown in FIGS. 6A and 6B as described above, the phase change amount of a signal transmitted to each output port due to the movement of the second substrate 218 may be determined as illustrated in Table 2.

TABLE 2

| | Phase | |
|---|---|---|
| Output Port | Default | Change Amount |
| P1 | 0° | 2α° |
| P2 | 0° | 0° |
| P3 | 0° | 4α° |
| P4 | 0° | −2α° |

Referring to Table 2, the phase change amount (2α°) of the signal transmitted to the output port P1 and the phase change amount (4α°) of the signal transmitted to the output port P3 are not in a symmetrical relationship with the phase change amount (0°) of the signal transmitted to the output port P2 and the phase change amount (−2α°) of the signal transmitted to the output port P4, in which the output ports P2 and P4 are opposite to the output ports P1 and P3.

In changing the phases of the signals transmitted to the respective output ports, according to the movement of the second substrate 218, the first section 641-1 may be used for adjusting not only the phase of the signal transmitted to the output port P2, but also the phase of the signal transmitted to the output port P4 equally by the first phase (α°). Since a connection line for adjusting the phase of the signal transmitted to the output port P2 by the first phase (α°) and a connection line for adjusting the phase of the signal transmitted to the output port P4 by the first phase (α°) are not separately required, the size of the phase shifter 120 can be reduced. For example, the size of the phase shifter 120 may be 156×64 $mm^2$.

Figure 7A:
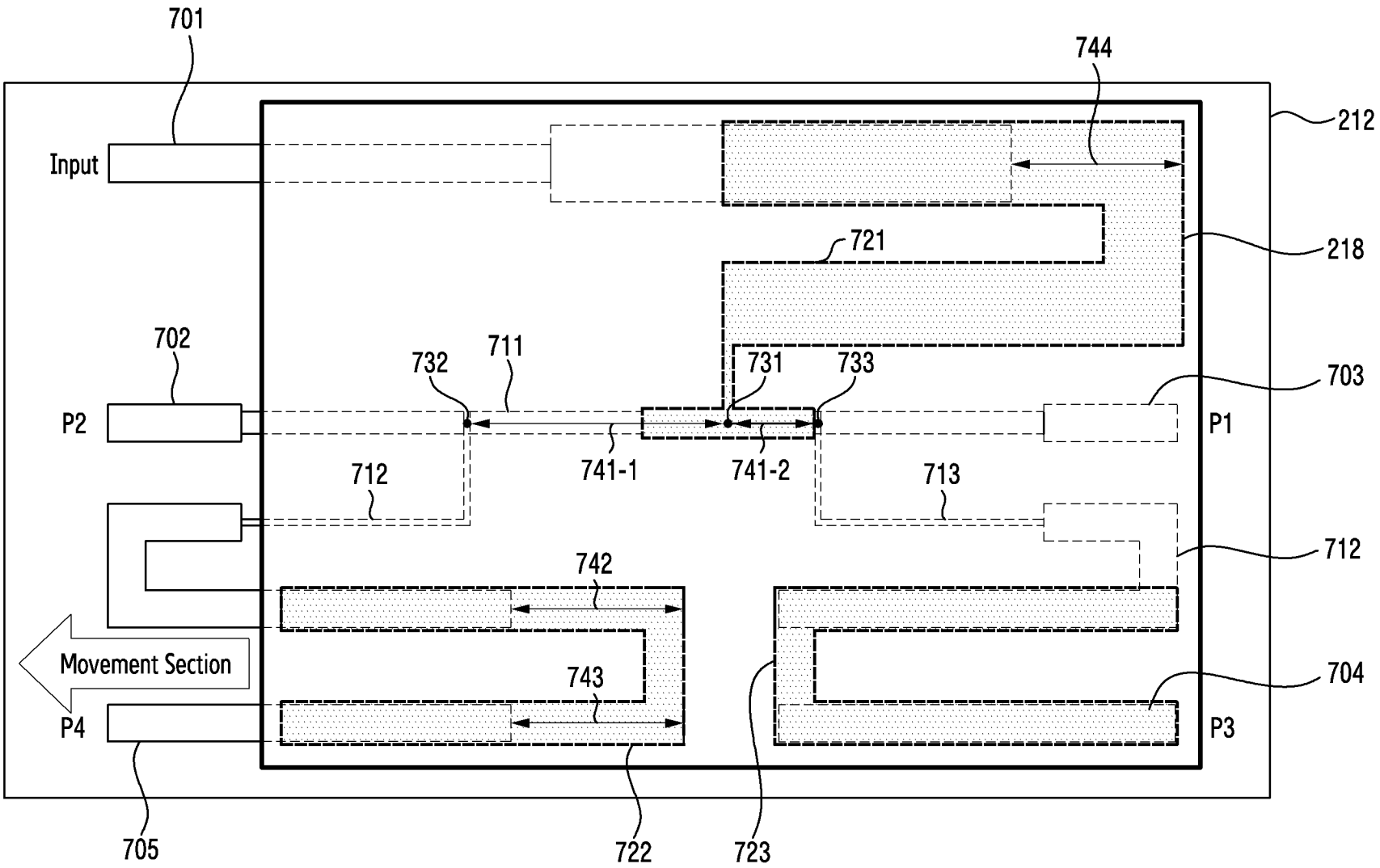
FIGS. 7A to 7C are diagrams of a first substrate configured to change the phase of an output signal before and after movement of a second substrate, according to embodiment.
Figure 7B:
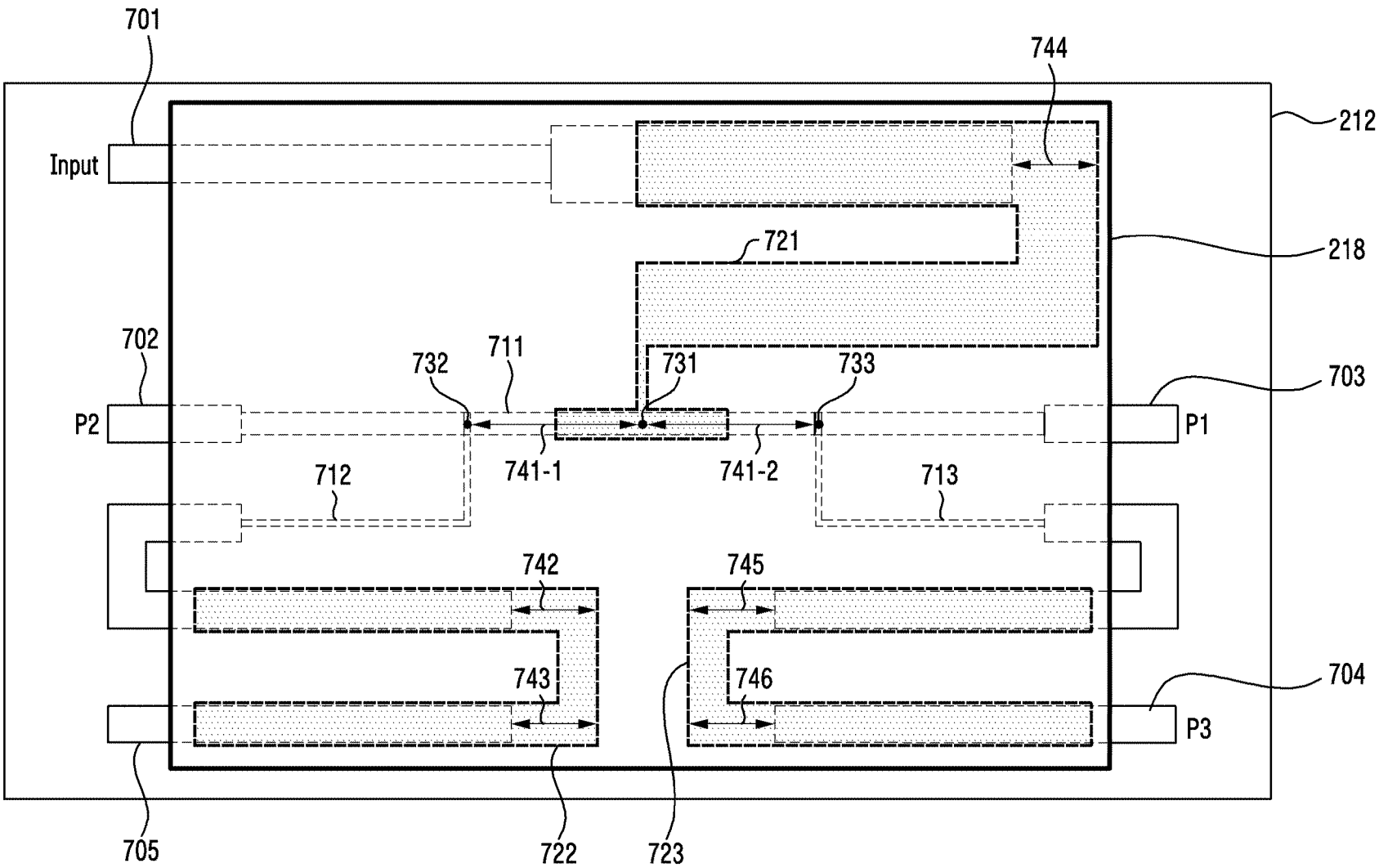
Figure 7C:
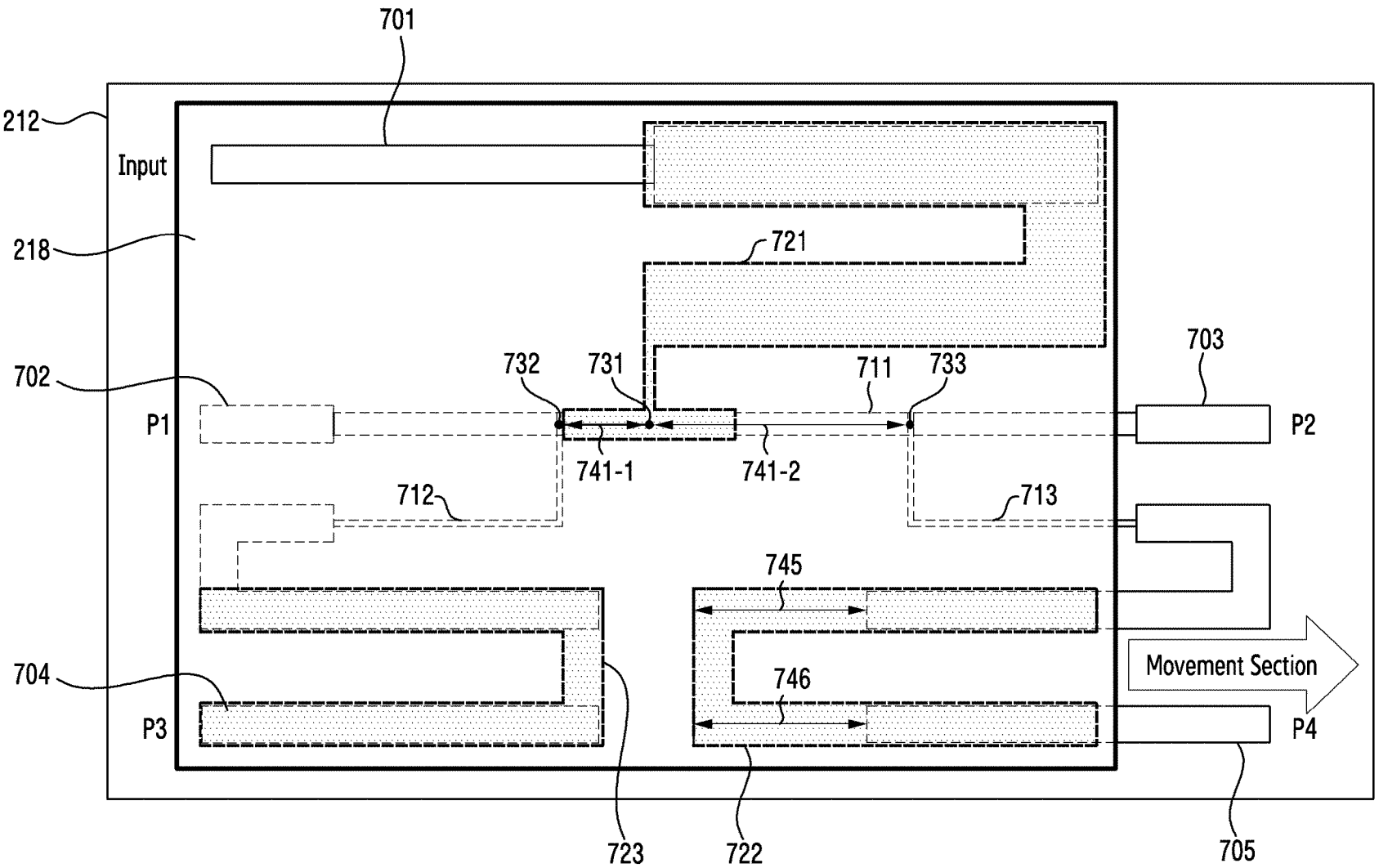

FIGS. 7A to 7C are diagrams of a first substrate configured to change the phase of an output signal before and after movement of a second substrate, according to an embodiment.

Referring to FIGS. 7A to 7C, the first substrate 212 includes an input line 701 connected to an input port, an output line 702 connected to an output port P1, an output line 703 connected to an output port P2, an output line 704 connected to an output port P3, an output line 705 connected to an output port P4, and connection lines 711 to 713. The connection line 711 may connect the output line 702 and the output line 703 to each other. The connection line 712 may be connected together at a point where the connection line 711 and the output line 703 are connected to each other. The connection line 713 may be connected together at a point where the connection line 711 and the output line 702 are connected to each other. The second substrate 218 includes a phase change line 721, a phase change line 722, and a phase change line 723.

The phase change line 721 of FIGS. 7A to 7C may be designed to have a size different from that of the phase change line 621 of FIGS. 6A to 6C for impedance matching. For example, the phase change line 721 of FIGS. 7A to 7C may be designed to be thicker and longer than the phase change line 621 of FIGS. 6A to 6C for impedance matching.

A signal transmitted from an input port and passing through the input line 701 may pass through a fifth section 744. The fifth section 744 may be a candidate portion which may be additionally coupled to the input line 701 in the phase change line 721 as the second substrate 218 moves. The signals passing through the fifth section 744 are branched, at a first branch node 731, into a signal directed toward the output ports P1 and P3 and a signal directed toward the output ports P2 and P4. The first branch node 731 may be the center of a portion where the phase change line 721 and the connection line 711 are coupled to each other.

Signals directed toward the output ports P2 and P4 through the phase change line 721 pass through a first section 741-1 and are branched again into a signal transmitted from a second branch node 732 toward the output port P2 and a signal transmitted from the second branch node 732 toward the output port P4. The second branch node 732 may be a point where the connection line 711, the connection line 712, and the output line 703 are connected together. Signals directed toward the output ports P1 and P3 through the phase change line 721 pass through a second section 741-2 and are branched again into a signal transmitted from a third branch node 733 toward the output port P1 and a signal transmitted from the third branch node 733 toward the output port P4. The third branch node 733 may be a point where the connection line 711, the connection line 713, and the output line 702 are connected together. The first section 741-1 may be a section from the first branch node 731 to the second branch node 732. The second section 741-2 may be a section from the first branch node 731 to the third branch node 733.

The signal transmitted to the output port P2 passes through the output line 703, and the signal transmitted to the output port P4 passes through a third section 742 and the fourth section 743. The third section 742 may be a candidate portion which may be additionally coupled to the connection line 712 in the phase change line 722 as the second substrate 218 moves. A fourth section 743 may be a candidate portion which may be additionally coupled to the output line 705 in the phase change line 722 as the second substrate 218 moves.

The signal transmitted to the output port P1 passes through the output line 702, and the signal transmitted to the output port P3 passes through a sixth section 745 and a seventh section 746. The sixth section 745 may be a portion where coupling with the connection line 713 is released from the phase change line 713 as the second substrate 218 moves. The seventh section 746 may be a portion where coupling with the output line 704 is released from the phase change line 723.

As the second substrate 218 moves, the length of the fifth section 744 decreases by the length of the movement section of the second substrate 218. Therefore, the phase of the signal transmitted to the output port P3 through the fifth section 744 decreases by the first phase ($\alpha°$).

As the second substrate 218 moves, the length of the first section 741-1 decreases by the length of the movement section of the second substrate 218. Therefore, the phase of the signal directed toward the output ports P2 and P4 through the first section 741-1 decreases by the first phase ($\alpha°$).

As the second substrate 218 moves, the length of the output line 703 does not change. As a result, the phase of the signal transmitted to the output port P2 after the movement of the second substrate 218 changes by $-2\alpha°$, compared to the phase before the movement of the second substrate 218.

In addition, as the second substrate 218 moves, the length of the third section 742 and the length of the fourth section 743 decreases by the length of the movement section of the second substrate 218. Therefore, the phase of the signal transmitted to the output port P4 through the third section 742 decreases by twice the first phase ($2\alpha°$). As a result, the phase of the signal transmitted to the output port P4 after the movement of the second substrate 218 changes by $-4\alpha°$, compared to the phase before the movement of the second substrate 218.

As the second substrate 218 moves, the length of the second section 741-2 increases by the length of the movement section of the second substrate 218. Therefore, the phase of the signal directed toward the output ports P1 and P3 through the second section 741-2 increases by the first phase ($\alpha°$).

As the second substrate 218 moves, the length of the output line 702 does not change, and the phase of the signal transmitted to the output port P1 after the movement of the second substrate 218 does not change, compared to the phase before the movement of the second substrate 218.

As the second substrate 218 moves, the length of the sixth section 745 and the length of the seventh section 746 increases by the length of the movement section of the second substrate 218. Therefore, the phase of the signal transmitted to the output port P3 through the sixth section 745 and the seventh section 746 increases by twice the first phase ($2\alpha°$). As a result, the phase of the signal transmitted to the output port P3 after the movement of the second substrate 218 changes by $+2\alpha°$, compared to the phase before the movement of the second substrate 218.

When the first substrate 212 and the second substrate 218 have line structures as shown in FIGS. 7A and 7B as described above, the phase change amount of a signal transmitted to each output port due to the movement of the second substrate 218 may be determined as illustrated in Table 3.

TABLE 3

| | Phase | |
|---|---|---|
| Output Port | Default | Change Amount |
| P1 | 0° | 0° |
| P2 | 0° | $-2\alpha°$ |
| P3 | 0° | $2\alpha°$ |
| P4 | 0° | $-4\alpha°$ |

Referring to Table 3, the phase change amount (0°) of the signal transmitted to the output port P1 is not in a symmetrical relationship with the phase change amount ($-2\alpha°$) of the signal transmitted to the output port P2 and the phase change amount ($-4\alpha°$) of the signal transmitted to the output port P4, in which the output ports P2 and P4 are opposite the first output port P1. The phase change amount ($-2\alpha°$) of the signal transmitted to the output port P2 is in a symmetrical relationship with the phase change amount ($2\alpha°$) of the signal transmitted to the output port P3. When the first substrate 212 and the second substrate 218 having line structures as shown in FIGS. 7A to 7C are used, the phase change amounts between signals transmitted to some output ports may be in a symmetrical relationship, and the phase change amounts between signals transmitted to the remaining output ports may not be in a symmetrical relationship.

Figure 8A:
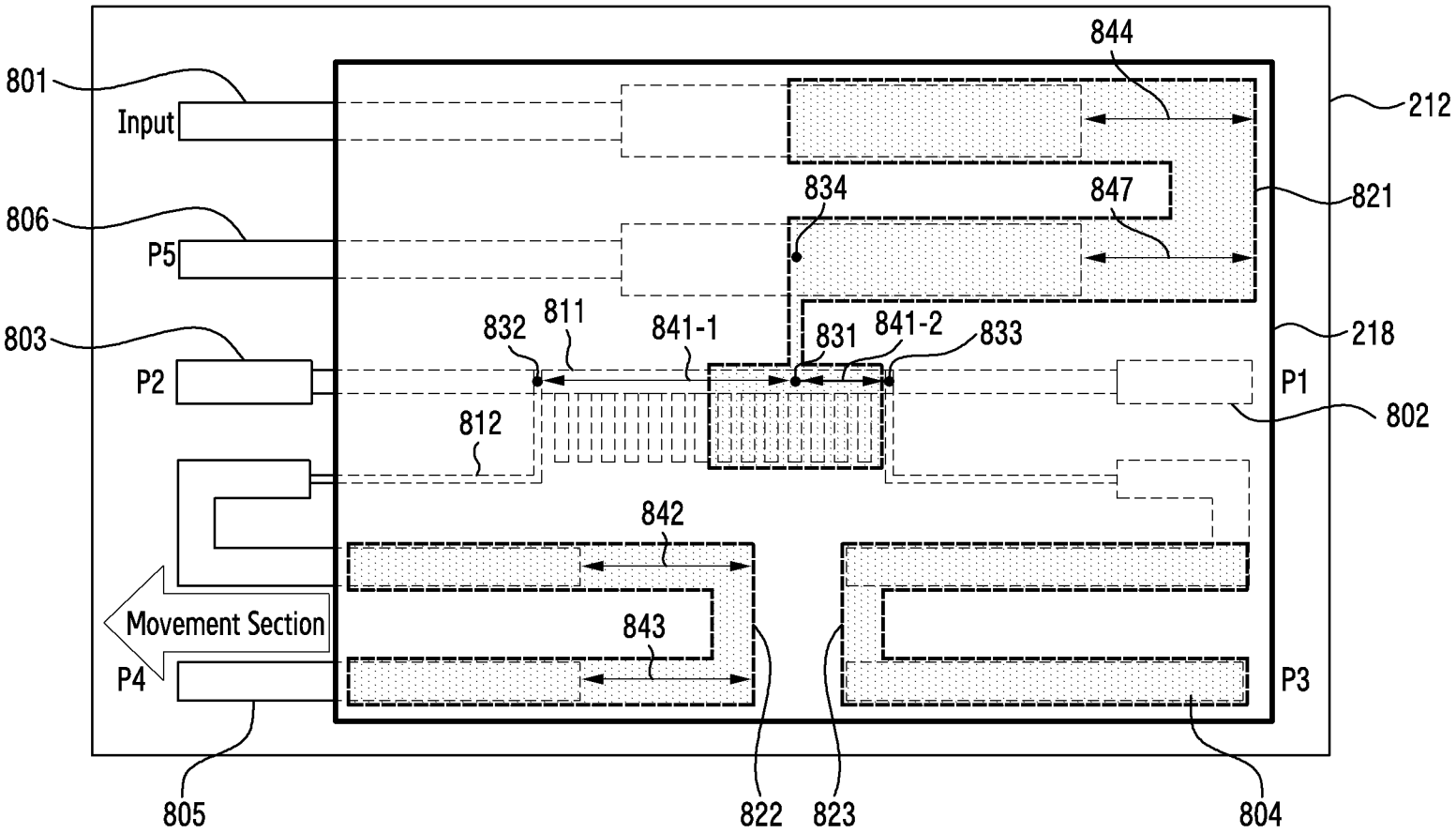
FIGS. 8A to 8C are diagrams of a first substrate configured to change the phase of an output signal before and after movement of a second substrate, according to embodiment.
Figure 8B:
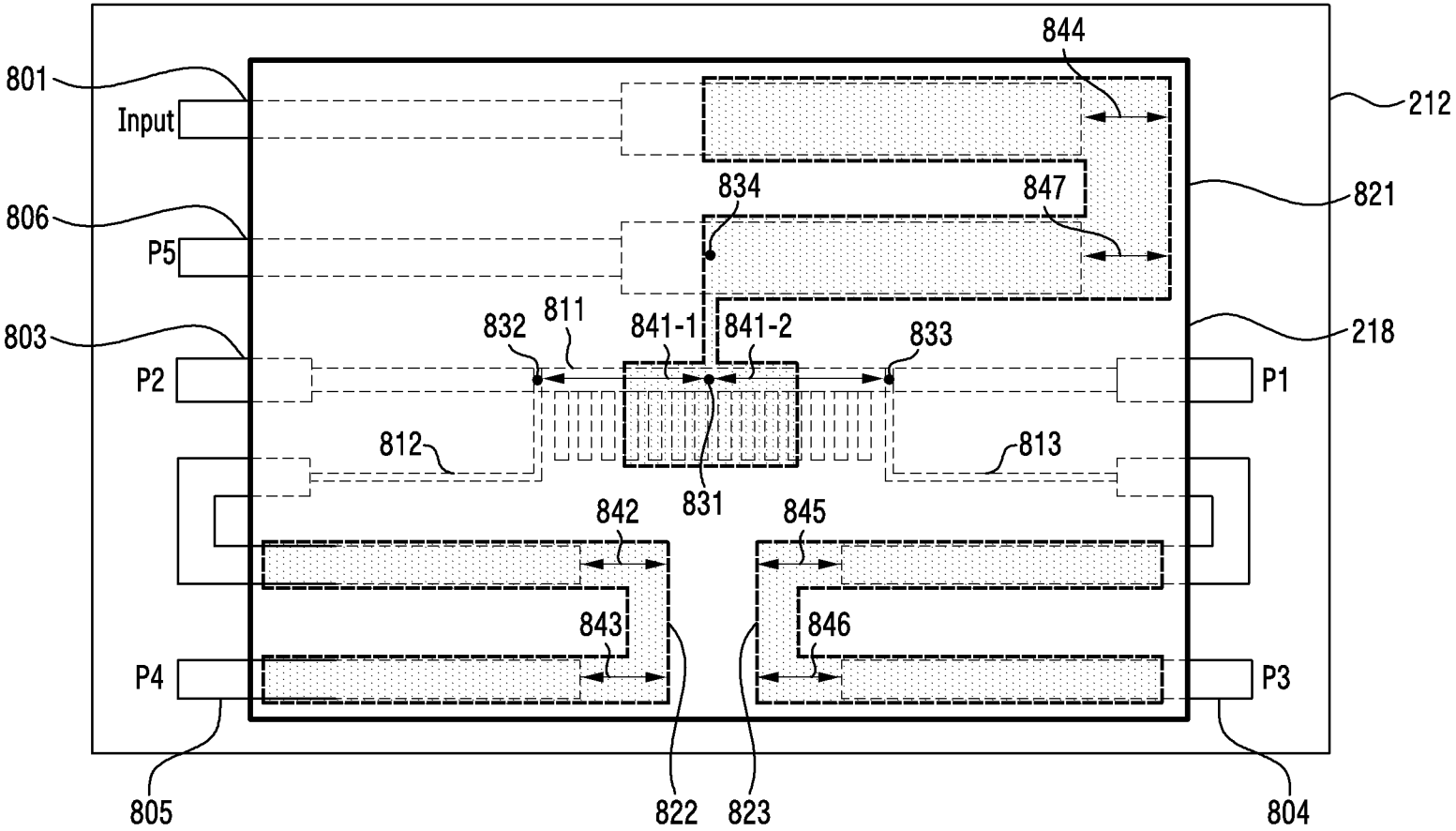
Figure 8C:
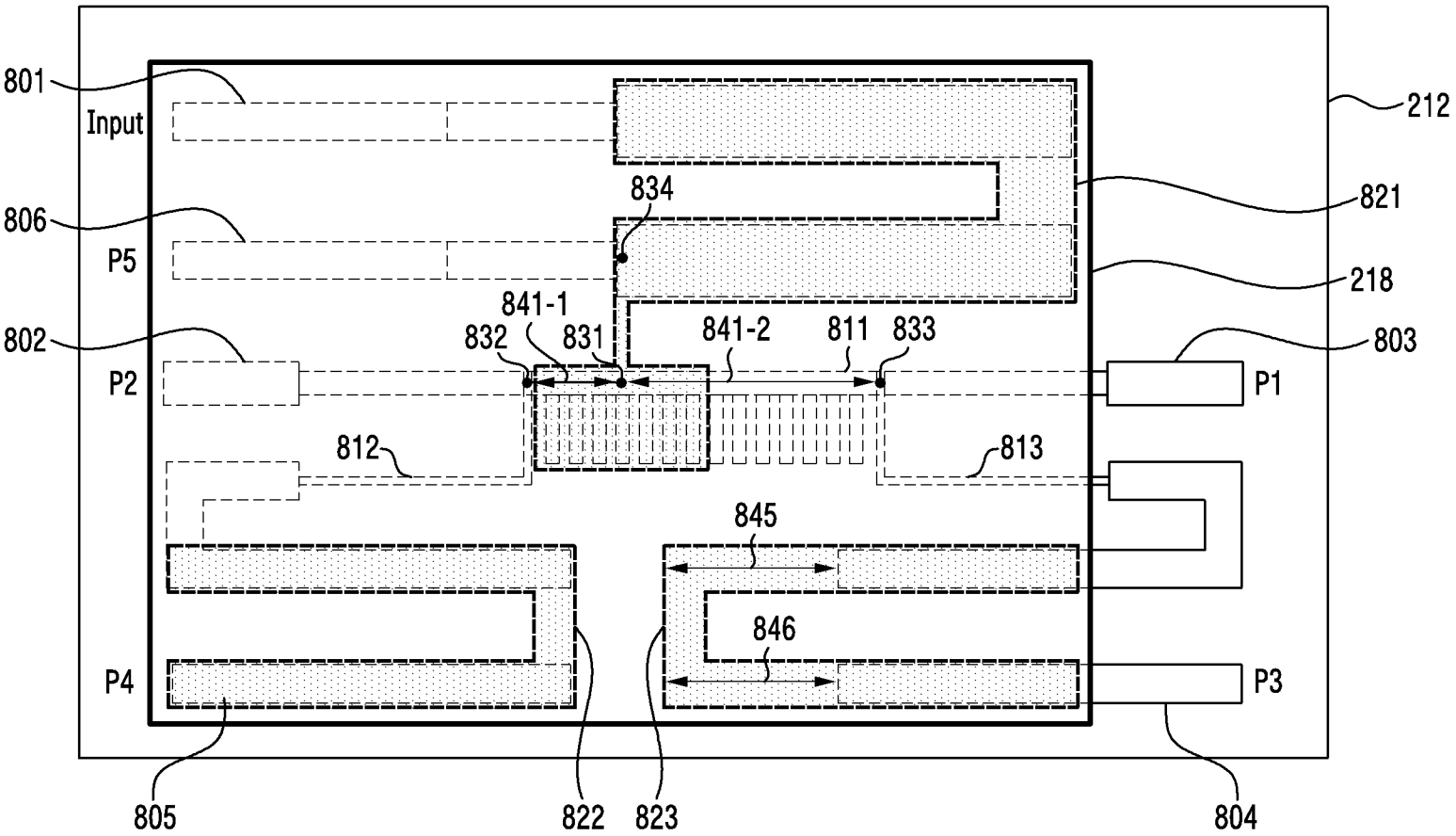

FIGS. 8A to 8C are diagrams of a first substrate configured to change the phase of an output signal before and after movement of a second substrate, according to an embodiment.

Referring to FIGS. 8A to 8C, the first substrate 212 includes an input line 801 connected to an input port, an output line 802 connected to an output port P1, an output line 803 connected to an output port P2, an output line 804 connected to an output port P3, an output line 805 connected to an output port P4, an output line 806 connected to the output port P5, and connection lines 811 to 813. The connection line 811 may connect the output line 802 and the output line 803 to each other. The connection line 812 may be connected together at a point where the connection line 811 and the output line 803 are connected to each other. The connection line 813 may be connected together at a point where the connection line 811 and the output line 802 are connected to each other. The second substrate 218 includes a phase change line 821, a phase change line 822, and a phase change line 823.

A signal transmitted from an input port and passing through the input line 801 may pass through a fifth section 844 and a eighth section 847. The fifth section 844 may be a candidate portion which may be additionally coupled to the input line 801 in the phase change line 821 as the second substrate 218 moves. The eighth section 847 may be a candidate portion which may be additionally coupled to the output line 806 in the phase change line 821 as the second substrate 218 moves. The signals passing through the fifth section 844 are branched, at a fourth branch node 834, into a signal directed transmitted to the output port P5 and a signal directed toward the output ports P1 to P4. The fourth branch node 834 may be a boundary point of a portion where the output line 806 and the phase change line 821 are coupled.

The signal branched at the fourth branch node 834 and transmitted to the output port P5 passes through the output line 806. The signals directed toward the output ports P1 to P4 are branched, at a first branch node 831, into a signal directed toward the output ports P1 and P3 and a signal directed toward the output ports P2 and P4. The first branch node 831 may be the center of a portion where the phase change line 821 and the connection line 811 are coupled to each other.

Signals directed toward the output ports P2 and P4 through the phase change line 821 pass through a first section 841-1 and are branched again into a signal transmitted from a second branch node 832 toward the output port P2 and a signal transmitted from the second branch node 832 toward the output port P4. The second branch node 832 may be a point where the connection line 811, the connection line 812, and the output line 803 are connected together. Signals directed toward the output ports P1 and P3 through the phase change line 821 pass through a second section 841-2 and are branched again into a signal transmitted from a third branch node 833 toward the output port P1 and a signal transmitted from the third branch node 833 toward the output port P4. The third branch node 833 may be a point where the connection line 811, the connection line 813, and the output line 802 are connected together. The first section 841-1 may be a section from the first branch node 833 to the second branch node 832. The second section 841-2 may be a section from the first branch node 831 to the third branch node 833.

The signal transmitted to the output port P2 passes through the output line 803, and the signal transmitted to the output port P4 passes through a third section 842 and a fourth section 843. The third section 842 may be a candidate portion which may be additionally coupled to the connection line 812 in the phase change line 822 as the second substrate 218 moves. The fourth section 843 may be a candidate portion which may be additionally coupled to the output line 805 in the phase change line 822 as the second substrate 218 moves.

The signal transmitted to the output port P1 passes through the output line 802, and the signal transmitted to the output port P3 passes through a sixth section 845 and a seventh section 846. The sixth section 845 may be a portion where coupling with the connection line 813 is released from the phase change line 823 as the second substrate 218 moves. The seventh section 846 may be a portion where coupling with the output line 804 is released from the phase change line 823 as the second substrate 213 moves.

As the second substrate 218 moves, the length of the fifth section 844 and the length of the eighth section 847 decreases by the length of the movement section of the second substrate 218. Therefore, the phase of the signal transmitted from the input port through the fifth section 844 and the eighth section 847 decreases by twice the first phase ($2\alpha°$). After the fifth section 844 and the eighth section 847 decreases, since there is no path change to the output port P5 according to the movement of the second substrate 218, the phase of a signal transmitted to the output port P5 changes by $-2\alpha°$.

As the second substrate 218 moves, the length of the first section 841-1 decreases by the length of the movement section of the second substrate 218. Therefore, the phase of the signal directed toward the output ports P2 and P4 through the first section 841-1 decreases by the second phase ($\beta°$).

As the second substrate 218 moves, the length of the output line 803 does not change. As a result, the phase of the signal transmitted to the output port P2 after the movement of the second substrate 218 changes by $-2\alpha°-\beta°$, compared to the phase before the movement of the second substrate 218.

As the second substrate 218 moves, the length of the third section 842 and the length of the fourth section 843 decreases by the length of the movement section of the second substrate 218. Therefore, the phase of the signal transmitted to the output port P4 through the third section 842 decreases by twice the first phase ($2\alpha°$). As a result, the phase of the signal transmitted to the output port P4 after the movement of the second substrate 218 changes by $-4\alpha°-\beta°$, compared to the phase before the movement of the second substrate 218.

As the second substrate 218 moves, the length of the second section 841-2 increases by the length of the movement section of the second substrate 218. Therefore, the phase of the signal directed toward the output ports P1 and P3 through the second section 841-2 increases by the second phase ($\beta°$).

As the second substrate 218 moves, the length of the output line 802 does not change. As a result, the phase of the signal transmitted to the output port P1 after the movement of the second substrate 218 changes by $-2\alpha°+\beta°$, compared to the phase before the movement of the second substrate 218.

As the second substrate 218 moves, the length of the sixth section 845 and the length of the seventh section 846 increases by the length of the movement section of the second substrate 218. Therefore, the phase of the signal transmitted to the output port P3 through the sixth section 845 and the seventh section 846 increases by twice the first phase ($2\alpha°$). As a result, the phase of the signal transmitted to the output port P3 after the movement of the second substrate 218 changes by $+\beta°$, compared to the phase before the movement of the second substrate 218.

When the first substrate 212 and the second substrate 218 have line structures as shown in FIGS. 8A and 8B as described above, the phase change amount of a signal transmitted to each output port due to the movement of the second substrate 218 may be determined as illustrated in Table 4.

TABLE 4

| | Phase | |
|---|---|---|
| Output Port | Default | Change Amount |
| P1 | 0° | $-2\alpha° + \beta°$ |
| P2 | 0° | $-2\alpha° - \beta°$ |
| P3 | 0° | $+\beta°$ |
| P4 | 0° | $-4\alpha° - \beta°$ |
| P5 | 0° | $-2\alpha°$ |

When the second phase ($\beta°$) is twice the first phase ($\alpha°$) ($\beta°=2\alpha°$), the phase change amount of a signal transmitted to each output port due to the movement of the second substrate 218 may be determined as in Table 5 below.

TABLE 5

| Output Port | Phase ($\beta° = 2\alpha°$) Default | Change Amount |
|---|---|---|
| P1 | 0° | 0° |
| P2 | 0° | −4α° |
| P3 | 0° | 2α° |
| P4 | 0° | −6α° |
| P5 | 0° | −2α° |

Referring to Table 5, it can be seen that the phase change amount (0°) of the signal transmitted to the output port P1 and the phase change amount (2α°) of the signal transmitted to the output port P3 are not in a symmetrical relationship with the phase change amount (−4α°) of the signal transmitted to the output port P2 and the phase change amount (−6α°) of the signal transmitted to the output port P4, in which the output ports P2 and P4 are opposite the output ports P1 and P3.

Figure 9:
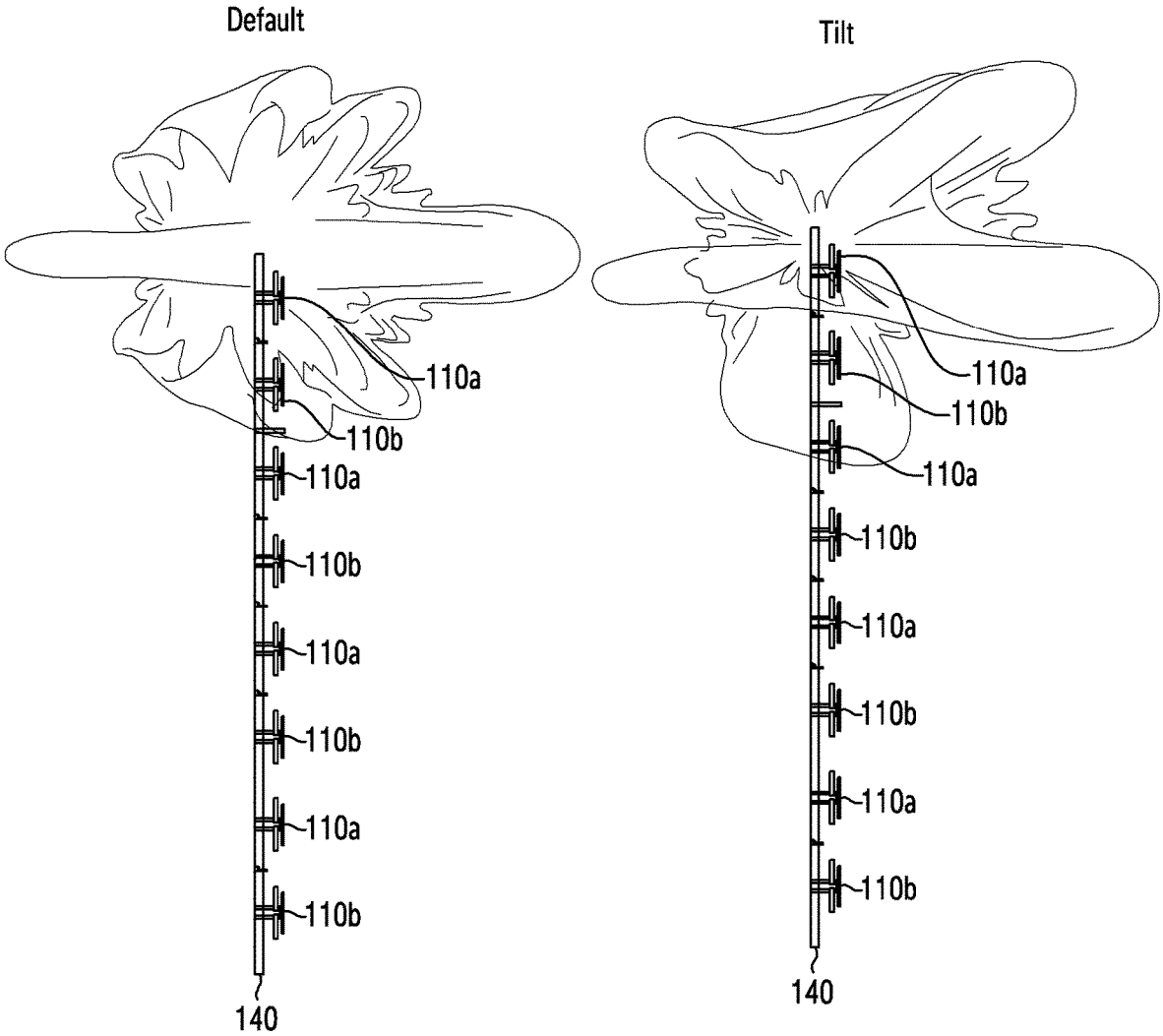
FIG. 9 is a diagram of a beam pattern variation of a beam tilt antenna according to a phase change, according to embodiment.

FIG. 9 is a diagram of a beam pattern variation of a beam tilt antenna according to a phase change, according to an embodiment.

Referring to FIG. 9, when the second substrate 218 is moved using the phase shifter 120, the beam radiated by the radiating element 110*a* included in the beam tilt antenna 100 is vertically tilted.

Figure 10A:
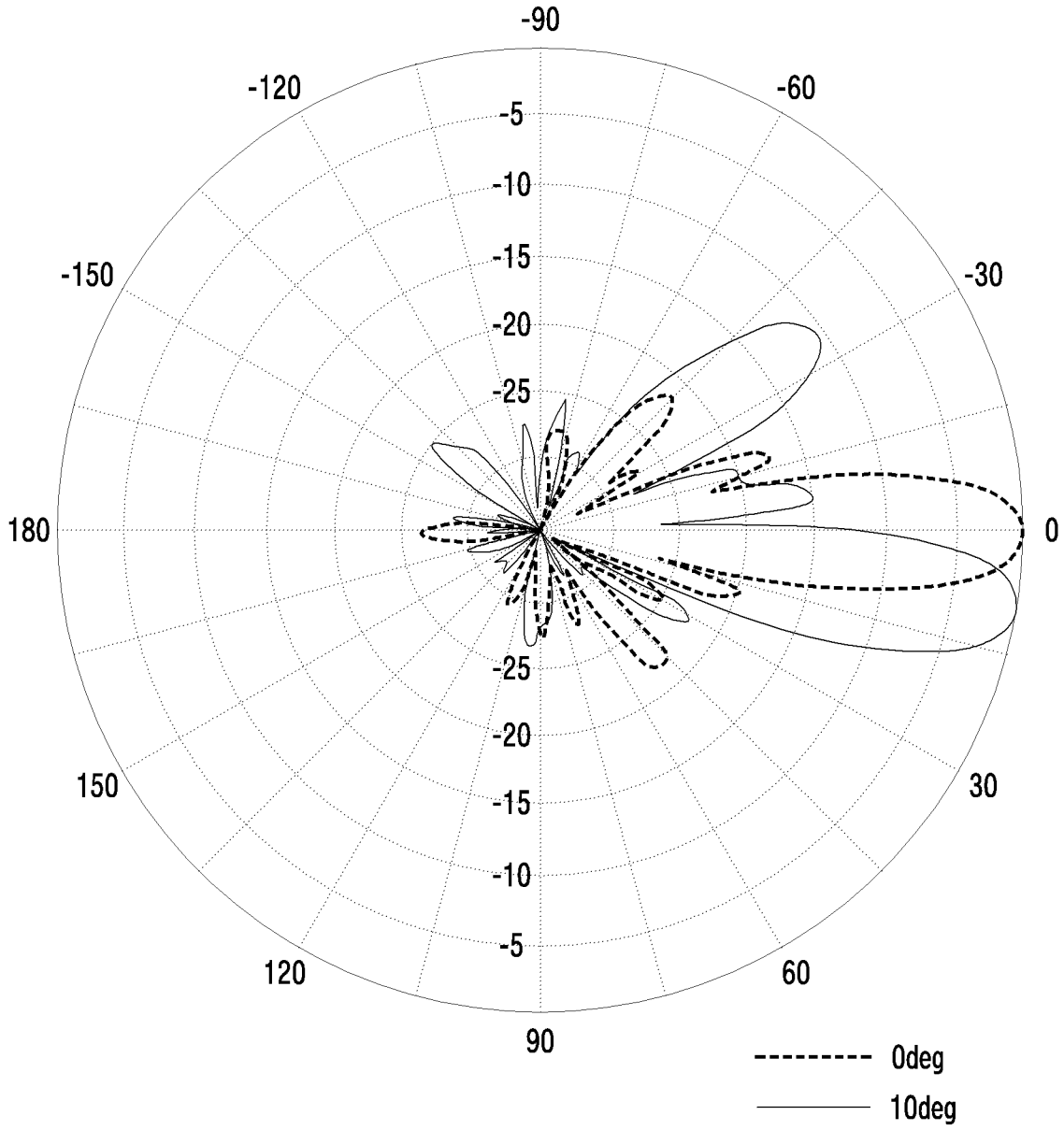
FIG. 10A is a diagram of a vertical beam pattern characteristic of a beam tilt antenna, according to embodiment.
Figure 10B:
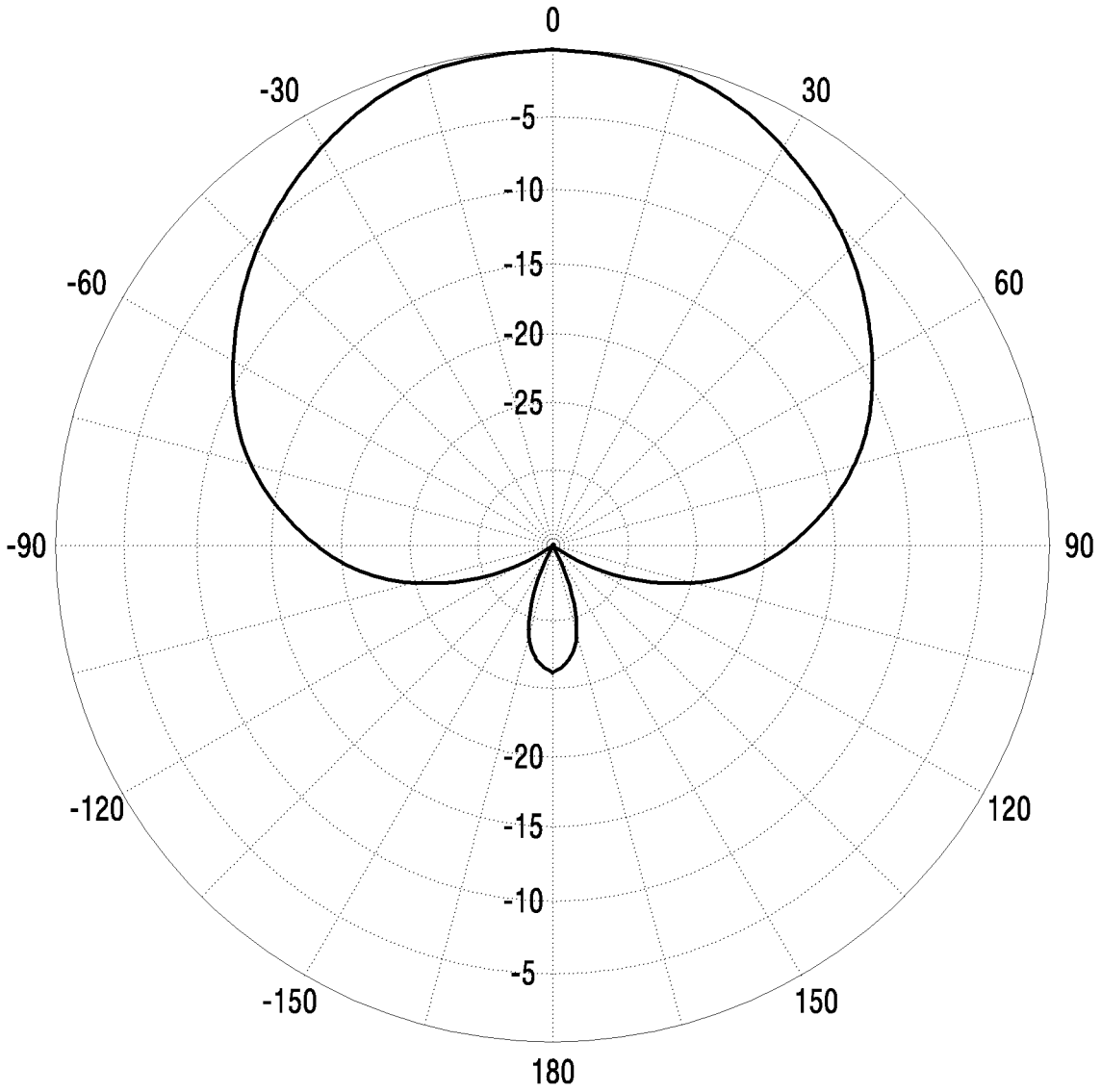
FIG. 10B is a diagram of a horizontal beam pattern characteristic of a beam tilt antenna, according to embodiment.

Referring to FIG. 10A, in the vertical beam pattern characteristic diagram of the beam tilt antenna 100, when the second substrate 218 is moved using the phase shifter 120, the vertical beam pattern changes by 10°. Referring to FIG. 10B, in the horizontal beam pattern characteristic diagram of the beam tilt antenna 100, when the second substrate 218 is moved using the phase shifter 120, the horizontal beam pattern is not changed. However, the horizontal beam pattern may also be changed depending on various factors such as an orientation of the beam tilt antenna 100, an arrangement of the radiating element 110*a* and the radiating element 110*b*, and/or one or more other contributing factors.

An apparatus described herein has a structure in which a phase of respective signals transmitted to different output ports can be adjusted together using one phase change line, so that the size of the phase shifter can be reduced.

While the disclosure has been shown and described with reference to certain embodiments thereof, it will be understood by those skilled in the art that various changes in form and details may be made therein without departing from the scope of the disclosure. Therefore, the scope of the disclosure should not be defined as being limited to the embodiments, but should be defined by the appended claims and equivalents thereof.

What is claimed is:

1. A phase shifter comprising:

a first substrate comprising a phase change line; and a second substrate comprising an input line connected to an input port, a first output line connected to a first output port, and a second output line connected to a second output port, wherein the first substrate faces the second substrate and is overlaid from the second substrate at a predetermined distance, and wherein a length of a first portion of the phase change line changes by a movement distance of the first substrate, and a phase of a signal passing through the first portion of the phase change line changes by a first value according to the length of the first portion of the phase change line.

2. The phase shifter of claim 1, wherein the phase change line comprises a first branch node at which an input signal passing through the input line is branched into signals different from the signal passing through the first portion of the phase change line, wherein the phase change line comprises a second branch node at which the signal passing through the first portion of the phase change line is branched into a first signal and a second signal that are configured to be transmitted to the first output port and the second output port, respectively, and wherein the first portion of the phase change line comprises a portion from the first branch node to the second branch node in the phase change line.

3. The phase shifter of claim 2, wherein the first branch node comprises a point where the phase change line and the input line are coupled.

4. The phase shifter of claim 2, wherein the second substrate further comprises a connection line connecting the first output line to the second output line, wherein a phase of the first signal, which passes through a first portion of the connection line, increases by the second value according to the movement distance of the first substrate, and wherein a phase of the second signal, which passes through a second portion of the connection line, decreases by the second value according to the movement distance of the first substrate.

5. The phase shifter of claim 4, wherein the first portion of the connection line comprises a portion from the second branch node to an end point of the connection line, which is connected to the first output line, in the connection line, and wherein the second portion of the connection line comprises a portion from the second branch node to another end point of the connection line, which is connected to the second output line, in the connection line.

6. The phase shifter of claim 5, wherein a length of the first portion of the connection line changes by the movement distance of the first substrate, and wherein a length of the second portion of the connection line changes by the movement distance of the first substrate.

7. The phase shifter of claim 1, wherein the first value is proportional to the movement distance of the first substrate.

8. A phase shifter comprising:

a first substrate comprising a phase change line; and a second substrate comprising an input line connected to an input port, a first output line connected to a first output port, a second output line connected to a second output port, and a connection line connecting the first output line to the second output line, wherein the first substrate faces the second substrate and is overlaid from the second substrate at a predetermined distance, and wherein a length of a first portion of the connection line changes by a movement distance of the first substrate, and a phase of a signal passing through the first portion of the connection line changes by a first value according to the length of the first portion of the connection line.

9. The phase shifter of claim 8, wherein the connection line comprises a branch node at which an input signal passing through the input line is branched into a first signal and a second signal that are configured to be transmitted to the first output port and the second output port, respectively, and wherein the first portion of the connection line comprises a portion from the branch node to an end point of the connection line, which is connected to the first output line, in the connection line.

10. The phase shifter of claim 8, wherein the second substrate further comprises another connection line, and wherein the another connection line connects the second output line to the connection line.

11. The phase shifter of claim 8, further comprises a phase change line, wherein the phase change line comprises a first branch node at which an input signal passing through the input line is branched into signal different from the signal passing through a first portion of the phase change line, wherein the phase change line comprises a second branch node at which the signal passing through the first portion of the phase change line is branched into a first signal and a second signal that are configured to be transmitted to the first output port and the second output port, respectively, wherein the first branch node is coupled to the input line, and wherein the second branch node is coupled to the input line.

12. The phase shifter of claim 11, wherein, when the first portion of the connection line comprises a comb line shape, the phase of the signal passing through the first portion of the connection line changes by a second value according to the movement distance of the first substrate, and wherein the second value is greater than the first value.

13. The phase shifter of claim 11, wherein the second substrate further comprises a third output line connected to a third output port, wherein a third portion of the phase change line is coupled to the third output line, wherein a phase of a third signal transmitted to the third output port through the third portion of the phase change line changes by a second value according to the movement distance of the first substrate, and wherein the second value is greater than the first value.

14. The phase shifter of claim 8, further comprising:

a motor configured to move the first substrate.

15. An antenna apparatus comprising:

a housing;

a first radiating element and a second radiating element disposed inside the housing; and a phase shifter disposed inside the housing and comprising, a first substrate comprising a phase change line; and a second substrate comprising an input line connected to an input port, a first output line connected to a first output port, and a second output line connected to a second output port, wherein the first substrate faces the second substrate and is overlaid from the second substrate at a predetermined distance, and wherein a length of a first portion of the phase change line changes by a movement distance of the first substrate, and a phase of a signal passing through the first portion of the phase change line changes by a first value according to the length of the first portion of the phase change line.

16. The antenna apparatus of claim 15, wherein the signal passing through the first portion of the phase change line is branched into a first signal and a second signal that are configured to be transmitted to the first output port and the second output port, respectively wherein the first radiating element is configured to radiate the first signal, and wherein the second radiating element is configured to radiate the second signal.

17. The antenna apparatus of claim 15, wherein the phase change line comprises a first branch node at which an input signal passing through the input line is branched into signals different from the signal passing through the first portion of the phase change line, wherein the phase change line comprises a second branch node at which the signal passing through the first portion of the phase change line is branched into a first signal and a second signal that are configured to be transmitted to the first output port and the second output port, respectively, and wherein the first portion of the phase change line comprises a portion from the first branch node to the second branch node in the phase change line.

18. The antenna apparatus of claim 17, wherein the second substrate further comprises a connection line connecting the first output line to the second output line, wherein a phase of the first signal which passes through a first portion of the connection line, increases by a second value according to the movement distance of the first substrate, and wherein a phase of the second signal, which passes through a second portion of the connection line, decreases by the second value according to the movement distance of the first substrate.

* * * * *